US005359255A

United States Patent [19]

Kawai et al.

[11] Patent Number: 5,359,255

[45] Date of Patent: Oct. 25, 1994

[54] DISCHARGE TUBE HAVING A DOUBLE-TUBE TYPE STRUCTURE

[75] Inventors: Koji Kawai; Shigeki Ishihara; Naoki Masuda, all of Hamamatsu, Japan

[73] Assignee: Hamamatsu Photonics K.K., Shizuoka, Japan

[21] Appl. No.: 918,759

[22] Filed: Jul. 27, 1992

[30] Foreign Application Priority Data

Jul. 25, 1991 [JP] Japan ..... 3-186544
Jun. 4, 1992 [JP] Japan ..... 4-144421

[51] Int. Cl.[5] ..... H01J 5/16; H01J 1/52; H01J 61/30

[52] U.S. Cl. ..... 313/17; 313/25; 313/113; 313/242; 313/634

[58] Field of Search ..... 313/25, 113, 17, 242, 313/634

[56] References Cited

U.S. PATENT DOCUMENTS

| | | | |
|---|---|---|---|
| 3,341,731 | 9/1967 | Wilson | 313/113 |
| 3,619,682 | 11/1971 | Lo et al. . | |
| 3,988,626 | 10/1976 | Boudouris | 313/113 |
| 4,791,333 | 12/1988 | Morris et al. | 313/113 |
| 4,935,668 | 6/1990 | Hansler et al. | 313/113 |
| 4,982,132 | 1/1991 | Meyer et al. | 313/113 |
| 5,032,758 | 7/1991 | Davenport et al. | 313/113 |
| 5,045,748 | 9/1991 | Ahlgren et al. | 313/113 |
| 5,059,865 | 10/1991 | Bergman et al. | 313/113 |
| 5,128,589 | 7/1992 | Dakin | 313/17 |
| 5,233,264 | 8/1993 | Tiesler et al. | 313/113 |

FOREIGN PATENT DOCUMENTS

| | | |
|---|---|---|
| 0331154 | 9/1989 | European Pat. Off. . |
| 3904927 | 8/1989 | Fed. Rep. of Germany . |
| 61-78044 | 4/1986 | Japan . |
| 3-37951 | 2/1991 | Japan . |

OTHER PUBLICATIONS

"Designing with Metal Halide Lamps" (pp. 59–68 of Electrode-Optical Systems Design published in Mar. of 1981.

Patent Abstracts of Japan vol. 15, No. 170 (E-1062), Apr. 30, 1991 (JPA 03 037 951).

*Primary Examiner*—Donald J. Yusko
*Assistant Examiner*—Matthew J. Esserman
*Attorney, Agent, or Firm*—Sughrue, Mion, Zinn, Macpeak & Seas

[57] ABSTRACT

A discharge tube for emitting light of the present invention includes an inner bulb including a hollow portion for defining therein an arc discharge chamber which encloses therein gas for emitting light, the inner bulb further including a pair of electrodes and a pair of metal members each of which is connected to a corresponding one of the pair of electrodes, the pair of electrodes being projected in the arc discharge chamber from the inner bulb and the pair of metal members being projected outwardly of the inner bulb, the hollow portion having an outer diameter of a first value and an outer tube for sealingly enclosing therein the inner bulb, the outer tube including a small-diameter portion having an outer diameter of a second value which is equal to or smaller than the first value, wherein the inner bulb is held in the interior of the outer tube, with a gap being formed between an outer surface of the inner bulb and an inner surface of the outer tube, in such a manner that the outer tube supports the metal members projected outwardly of the inner bulb.

33 Claims, 13 Drawing Sheets

DISCHARGE TUBE HAVING A DOUBLE-TUBE TYPE STRUCTURE

BACKGROUND OF THE INVENTION

1. Field of the Invention

The present invention relates to a discharge tube, a light source employing the discharge tube, and a method of producing the discharge tube.

2. Description of Related Art

A discharge tube such as a metal vapor discharge tube is conventionally used for a light source employed in a liquid crystal (LC) projection device in which the light source irradiates an LC panel with light to thereby project an LC imaging light onto a screen. The discharge tube is generally of a double-tube structure in which an inner bulb is sealingly enclosed in the interior of an outer tube. The inner bulb is formed with an arc discharge chamber in which a pair of electrodes are sealingly enclosed to be opposed to each other. The pair of electrodes serve to generate arc discharge therebetween in the arc discharge chamber so as to generate light. The inner bulb is sealingly enclosed in a cylindrically-shaped outer tube. The interior of the outer tube is in a vacuum state or is filled with a small amount of inert gas so as to thermally insulate the inner bulb enclosed in the outer tube from atmospheric air outside, to thereby enhance the heat accumulating capacity of the inner bulb. The discharge tube of the double-tube structure therefore has the following great advantage relative to a discharge tube of a single-bulb structure in which the inner bulb is not enclosed in the outer tube but is exposed to atmospheric air outside. That is, the volume of the inner bulb (i.e., the volume of the arc discharge chamber of the inner bulb) of the double-tube structure type attainable of a desired light emission efficiency with a rated electrical power is larger than that of the single-bulb structure type attainable of the desired light emission efficiency with the same rated electrical power. In other words, in the discharge tube of the double-tube structure, it is possible to attain the desired light emission efficiency with the rated electrical power, with the inner bulb of a larger volume, relative to the discharge tube of the single-bulb structure. Accordingly, the total area of the inner surface of the inner bulb of the double-tube structure becomes larger than that of the single-bulb structure. In the case where the discharge tubes of the double-tube structure and of the single-bulb structure are operated for the same period of time, the same amount of matter is spattered on the inner surfaces of the inner tubes. Accordingly, even in the case where the discharge tubes of the double-tube structure and of the single-bulb structure are operated for the same period of time, the amount of the matter spattered on an inner surface of the inner bulb of the double-tube structure per unit area becomes smaller than that of the matter spattered on an inner surface of the inner bulb of the single-bulb structure per unit area. Therefore, the lifetime of the discharge tube of the double-tube structure becomes larger than that of the single-bulb structure.

In order to produce the above-described discharge tube of the double-tube structure, the inner bulb is inserted into the interior of the outer tube from one of a pair of end portions of the outer tube, and the end portions of the outer tube is sealed.

Japanese Unexamined Patent Application Publication Nos. 61-78044 and 3-37951 disclose the discharge tubes of the double-tube structure type. In the discharge tube disclosed in the publication No.61-78044, an air suction pipe is sealingly passed through a sealing portion which is formed at one end of an outer tube thereof through pressure deformation treatment so that one end of the air suction pipe is positioned in the interior of the outer tube. A lead wire which is connected, at its one end, to an inner bulb is tied, at its other end, on the end of the air suction pipe positioned inside of the outer tube. Thus, the inner bulb is held in the interior of the outer tube in such a manner that the inner bulb is supported via the lead wire on the air suction pipe.

In the discharge tube disclosed in the publication No.3-37951, a tip end of the air suction pipe is projected inwardly of the outer tube from one end thereof. An inner bulb is supported via a mounting member on the tip end of the air suction pipe so that the inner bulb is held in the interior of the outer tube.

Each of the above-described discharge tubes of the publication Nos.61-78044 and 3-37951 has, however, such problems that the inner bulb supporting mechanism thereof is intricate in its structure and therefore has a low strength.

In order to solve the above-described problem, a discharge tube as shown in FIG. 1 has been proposed. The discharge tube 72 shown in FIG. 1 is of the double-tube structure in which an inner bulb 76 is sealingly enclosed in a cylindrically-shaped outer tube 77. The inner bulb 76 has a pair of columnar-shaped solid portions 80 for sealingly supporting therein a pair of electrodes 74 and a spherically-shaped hollow portion 75 defining a spherically-shaped arc discharge chamber 75' for enclosing therein xenon, metal vapor, or the like. The spherically-shaped hollow portion 75 is positioned between the solid portions 80 so that the pair of electrodes 74 may be projected from the solid portions into the arc discharge chamber 75'. The pair of electrodes 74 serve to generate an arc discharge therebetween in the arc discharge chamber 75'. A pair of lead wires 81 are connected to the pair of electrodes 74 embedded in the solid portions 80. The inner bulb 76 is held inside of the outer tube 77 in such a manner that the pair of lead wires 81 thus connected to the electrodes 74 are sealingly supported by a pair of sealed portions 82 which are air-shieldingly formed at both ends of the cylindrically-shaped outer tube 77. Thus, the inner bulb 76 is supported in the interior of the outer tube 77 via the pair of lead wires 81 in such a manner that the inner bulb 76 is not directly contacted with the outer tube 77. The interior of the outer tube 77 is in a vacuum state or is filled with a small amount of inert gas, so that the internal bulb 76 is thermally insulated from atmospheric air.

The above-described discharge tube 72 is simple in its structure so that it is possible to easily decrease the size of the discharge tube 72. The strength of the discharge tube 72 can be enhanced.

When the above-proposed discharge tube 72 is to be produced, the inner bulb 76 is first inserted into the cylindrically-shaped outer tube 77 through one of its opposed open ends. Then, the outer tube 77 is thermally deformed, at the open ends, into the sealed portions 82 so that the pair of lead wires 81 may be sealingly passed through the sealed portions 82, respectively. As a result, the inner bulb 76 is supported in the outer tube 77 via the pair of lead wires 81.

The above-described discharge tube 72 has been proposed to be attached to a reflective mirror so that a light source may be produced, as shown in FIG. 2.

FIG. 2 illustrates a light source to be employed for an LC projection device. The LC projection device includes the light source and an LC panel, and is positioned relative to a wide screen in such a position that the light radiated from the light source may pass through the LC panel to be projected onto the wide screen. In the LC projection device, the light source radiates light onto an LC panel which displays a desired image thereon so that a desired imaging light may be projected from the LC panel onto the wide screen.

As shown in FIG. 2, the light source 71 is constructed by attaching the discharge tube 72 as shown in FIG. 1 to a parabolic reflective mirror 73. The discharge tube 72 is inserted, at its mounting portion 78, into an access through-hole 79 of the reflective mirror 73, and is fixed thereto. The discharge tube 72 is attached to the parabolic reflective mirror 73 at such a position that a center position of the arc discharge chamber 75' may be positioned at a focal point F of the parabolic mirror 73. Light generated in the arc discharge chamber 75' proceeds in a forward direction of the reflective mirror 73 indicated by an arrow in FIG. 2 (leftward direction in FIG. 2) or proceeds in a rearward direction toward the surface of the reflective mirror 73 (rightward direction in FIG. 2) to be reflected thereat and proceed forwardly. The light source 71 therefore serves to radiate a parallel light beam in the forward direction (leftward direction in FIG. 2) so that the light beam may be effectively projected onto a surface of the LC display which is positioned forwardly of the light source 71.

It is noted that since it is necessary to insert the inner bulb 76 into the outer tube 77 through the open end of the cylindrically-shaped outer tube 77, the outer diameter of the outer tube 77 of the discharge tube 72 is larger than the outer diameter of the spherically-shaped hollow portion 75 of the inner bulb 76 as described above. Accordingly, the inner diameter of the access through-hole 79 of the reflective mirror 73 which is equal to or slightly larger than the outer diameter of the outer tube 77 is larger than the outer diameter of the hollow portion 75. The diameter of the access through-hole 79 is therefore large relative to the inner diameter of the arc discharge chamber 75'. Since the area of the access through-hole 79 confronting the arc discharge chamber 75' is thus large, a large part of the light beam radiated rearwardly from the arc discharge chamber 75' reaches the access hole 79 and fails to be reflected at the mirror surface 73. The light source 71 therefore has a problem that it fails to effectively or fully direct the light beam emitted from the discharge tube 72 forwardly to the LC display panel.

FIG. 3 illustrates another conventional discharge tube of the double-tube structure type which is proposed in "Designing with Metal Halide Lamps" (pp. 59–68 of "ELECTROOPTICAL SYSTEMS DESIGN" published in March of 1981). The discharge tube 172 is also in the double-tube structure including an inner bulb 176 and an outer tube 177 sealingly enclosing therein the inner bulb 176. The inner bulb 176 has a pair of columnar-shaped solid portions 180. In each of the solid-portions 180, an electrode 174, a pair of metal (molybdenum) foils 181 and 181' connected to one another are sealingly embedded in such a manner that the electrode 174 and the metal foil 181' may be projected from opposite ends of the each solid portion 180. The inner bulb 176 further has a substantially spherically-shaped hollow portion 175 at a position between the pair of columnar-shaped solid portions 180. The spherically-shaped hollow portion 175 defines therein an arc discharge chamber 175' for enclosing therein metal halide vapor gas and for generating arc discharge between the electrodes 174 and 174 which are projected in the arc discharge chamber 175' from the solid portions 180. The outer diameter of the spherically-shaped hollow portion 175 is larger than that of the columnar-shaped solid portions 180.

The outer tube 177 of the discharge tube 172 consists of a hollow portion 182 for receiving therein the spherically-shaped hollow portion 175 of the inner bulb 176. The outer tube 177 and the inner bulb 176 are continuously connected to each other in such a manner that the wall 182" of the hollow portion 182 of the outer tube 177 is connected to the pair of columnar-shaped solid portions 180 of the inner bulb 176.

Accordingly, the present inventors perceive that the discharge tube 172 may be combined with the parabolic reflective mirror 73 as shown in FIG. 2 in such a manner that the columnar-shaped solid portion 180 projected outwardly of the discharge tube 172 is inserted into the access through-hole 21 of the parabolic reflective mirror 73 and is fixed thereto. Since the diameter of the columnar-shaped solid portion 180 is smaller than that of the spherically-shaped hollow portion 175, it is possible to combine the discharge tube 172 with such a reflective mirror 73 as having the access through-hole 21 of a small diameter. In the case where the discharge tube 172 is thus fixed to the reflective mirror with the access through-hole of the small diameter, since the area of the access hole is small, only a small part of the light emitted rearwardly from the arc discharge chamber 175' reaches the access through-hole not to be reflected at the mirror surface. Accordingly, the obtained light source can effectively direct the light beam emitted from the discharge tube 172 forwardly.

The discharge tube 172 has, however, a problem that since the wall 182" of the outer tube 177 is in direct contact with the columnar-shaped solid portions 180 of the inner bulb 176, it is impossible to thermally insulate the inner bulb 176 from the atmospheric outside air reliably and certainly. In other words, the discharge tube 172 has the double-tube structure only at the arc discharge chamber 175' of the inner bulb 176, but has a single-tube structure at the columnar-shaped solid portions 180 of the inner bulb. With such a structure, it is impossible to fully or completely thermally insulate the inner bulb 176 from the atmospheric air. Accordingly, the life time of the discharge tube 172 is not so large with respect to that of the conventional discharge tube 72.

SUMMARY OF THE INVENTION

The present invention is achieved to solve the above-described defects. An object of the present invention is therefore to provide a discharge tube of the double-tube structure that has a simple structure to attain a high strength, that may be combined with a reflective mirror to effectively introduce the generated light in a forward direction thereof, and that is capable of thermally insulating the inner bulb from the atmospheric air outside reliably and certainly to thereby enhance the lifetime thereof. Another object of the present invention is to provide a method of producing the discharge tube.

In order to attain the above-described objects, the present invention provides a discharge tube for emitting light, including: an inner bulb including a hollow portion for defining therein an arc discharge chamber which encloses therein gas for emitting light, the inner bulb further including a pair of electrodes and a pair of metal members each of which is connected to a corresponding one of the pair of electrodes, the pair of electrodes being projected in the arc discharge chamber from the inner bulb and the pair of metal members being projected outwardly of said inner bulb, the hollow portion having an outer diameter of a first value; and an outer tube for sealingly enclosing therein the inner bulb, the outer tube including a small-diameter portion having an outer diameter of a second value which is equal to or smaller than the first value, wherein the inner bulb is held in the interior of the outer tube, with a gap being formed between an outer surface of the inner bulb and an inner surface of the outer tube, in such a manner that the outer tube supports the metal members projected outwardly of the inner bulb.

The inner bulb further includes a solid portion for supporting at least one of the pair of electrodes and for supporting at least one of the pair of metal members connected to the at least one of the pair of electrodes, the at least one of the pair of electrodes being projected inside of the arc discharge chamber from the solid portion and the at least one of the pair of metal members being projected outwardly of the inner bulb from the solid portion. The outer tube includes a large-diameter hollow portion and a small-diameter hollow portion which are continuously connected with each other, the outer tube enclosing therein the inner bulb in such a manner that the large-diameter hollow portion receives therein the hollow portion of the inner bulb, with a gap being formed between an outer surface of the hollow portion of the inner bulb and an inner surface of the large-diameter hollow portion of the outer tube, and the small-diameter hollow portion receives therein the solid portion of the inner bulb and the metal member projected from the solid portion, with a gap being formed between an outer surface of the solid portion of the inner bulb and an inner surface of the small-diameter hollow portion of the outer tube, the small-diameter hollow portion having an outer diameter of the second value which is equal to or smaller than the first value.

The solid portion of the inner bulb has an outer diameter of a third value, and the large-diameter hollow portion of the outer tube has an inner diameter of a fourth value which is larger than the first value so that a gap may be formed between an outer surface of the hollow portion of the inner bulb and an inner surface of the large-diameter hollow portion of the outer tube. The small-diameter hollow portion of the outer tube has an inner diameter of a fifth value which is larger than the third value so that a gap may be formed between an outer surface of the solid portion of the inner bulb and an inner surface of the small-diameter hollow portion of the outer tube.

The outer tube further includes a solid portion which is continuously connected to the small-diameter hollow portion, the solid portion of the outer tube supporting the metal members projected outwardly of the inner bulb, to thereby hold the inner bulb in the interior of the large-diameter hollow portion and the small-diameter hollow portion of the outer tube, with a gap being formed between the outer surface of the inner bulb and the inner surface of the outer tube.

According to another aspect, the present invention provides a light source for emitting light in a desired direction, which includes: a discharge tube which has an inner bulb including a hollow portion for defining therein an arc discharge chamber which encloses therein gas for emitting light, the inner bulb further including a pair of electrodes and a pair of metal members each of which is connected to a corresponding one of the pair of electrodes, the pair of electrodes being projected in the arc discharge chamber from the inner bulb and the pair of metal members being projected outwardly of the inner bulb, the hollow portion having an outer diameter of a first value, and an outer tube for sealingly enclosing therein the inner bulb, the outer tube including a small-diameter portion having an outer diameter of a second value which is equal to or smaller than the first value, the inner bulb being held in the interior of the outer tube, with a gap being formed between an outer surface of the inner bulb and an inner surface of the outer tube, in such a manner that the outer tube supports the metal members projected outwardly of the inner bulb; and a reflective mirror having a through-hole for receiving therein the small-diameter portion of the outer tube of the discharge tube.

The discharge tube is preferably attached to the reflective mirror in such a manner that the through-hole of the reflective mirror may be positioned within a shadow space area where light having passed through a portion of the inner bulb having a light transmittance of a low value is reached.

In the case where the inner bulb of the discharge tube further includes a solid portion for supporting at least one of the pair of electrodes and for supporting at least one of the pair of metal members connected to the at least one of the pair of electrodes, the at least one of the pair of electrodes being projected inside of the arc discharge chamber from the solid portion and the at least one of the pair of metal members being projected outwardly of the inner bulb from the solid portion, the solid portion of the inner bulb having an outer diameter of a third value, and in the case where the outer tube of the discharge tube includes a large-diameter hollow portion and a small-diameter hollow portion which are continuously connected with each other, the outer tube enclosing therein the inner bulb in such a manner that the large-diameter hollow portion receives therein the hollow portion of the inner bulb and the small-diameter hollow portion receives therein the solid portion of the inner bulb and the metal member projected from the solid portion, the large-diameter hollow portion of the outer tube having an inner diameter of a fourth value which is larger than the first value so that a gap may be formed between an outer surface of the hollow portion of the inner bulb and an inner surface of the large-diameter hollow portion of the outer tube, the small-diameter hollow portion of the outer tube having an outer diameter of the second value which is equal to or smaller than the first value and having an inner diameter of a fifth value which is larger than the third value so that a gap may be formed between an outer surface of the solid portion of the inner bulb and an inner surface of the small-diameter hollow portion of the outer tube, the discharge tube is attached to the reflective mirror in such a manner that the small-diameter hollow portion of the outer tube is inserted into and fixed to the through-hole of said reflective mirror, the through-hole having an inner diameter of a sixth value which is equal to or slightly larger than the second value.

The outer tube of the discharge tube further includes a solid portion which is continuously connected to the small-diameter hollow portion, the solid portion of the outer tube supporting the metal member projected outwardly of the inner bulb to thereby hold the inner bulb in the interior of the large-diameter hollow portion and the small-diameter hollow portion of the outer tube. In this case, the discharge tube should be preferably attached to the reflective mirror in such a manner that the through-hole of the reflective mirror may be positioned within a cone-shaped shadow space area which is determined by its generating line which is defined by an imaginary line connecting a tip end of the electrode supported in the solid portion and a boundary portion between the hollow portion and the solid portion of the inner bulb.

According to further aspect, the present invention provides a method of producing a discharge tube, including the steps of: preparing an inner bulb including a hollow portion for defining therein an arc discharge chamber enclosing therein gas for emitting light, the inner bulb further including a pair of electrodes exposed in the arc discharge chamber and a pair of metal members connected to a corresponding one of the pair of electrodes in such a manner that the pair of metal members are projected outwardly of the inner bulb, the hollow portion having an outer diameter of a first value; preparing a first outer pipe having a large-diameter hollow part and a small-diameter hollow part continuously connected with each other, the small-diameter hollow part having an outer diameter of a second value which is equal to or smaller than the first value, the first outer pipe having a first and second open ends at the large-diameter hollow part and at the small-diameter hollow part, respectively; preparing a second outer pipe having a large-diameter hollow part and a small-diameter hollow part continuously connected with each other, the second outer pipe having an open end and a closed end at the large-diameter hollow part and at the small-diameter hollow part, respectively; connecting the first and second outer pipes, with the first open end of the first outer pipe facing the open end of the second outer pipe, to thereby continuously connect the large-diameter hollow parts of the first and second outer pipes, in such a manner that the inner bulb may be positioned in the interior of the thus connected first and second outer pipes so that the hollow portion of the inner bulb may be received in at least one of the large-diameter hollow parts of the first and second outer pipes and the pair of metal members projected outwardly of the inner bulb may be received in the small-diameter hollow parts of the first and second outer pipes; drawing air from the interior of the thus connected first and second outer pipes through the second open end of the first outer pipe; deforming portions of the small-diameter hollow parts of the first and second outer pipes surrounding the metal members projected outwardly of the inner bulb into solid parts with the metal members being embedded therein; and cutting the thus formed solid parts, to thereby obtain a discharge tube in which the inner bulb is sealingly enclosed in an outer tube in such a manner that the hollow portion of the inner bulb may be received in the large-diameter part of the outer tube and the metal members projected outwardly of the inner bulb may be received in the solid parts, with a gap being formed between an outer surface of the inner bulb and an inner surface of the outer tube.

The hollow portion of the inner bulb is received in the large-diameter part of the first outer pipe and an inner diameter of the large-diameter part of the first outer pipe has a fourth value which is larger than the first value so that a gap may be formed between the outer surface of the inner bulb and the inner surface of the outer tube.

In the case where the inner bulb further includes a solid portion for supporting at least one of the pair of electrodes and for supporting at least one of the pair of metal members connected to the at least one of the pair of electrodes, the at least one of the pair of electrodes being projected inside of the arc discharge chamber from the solid portion and the at least one of the pair of metal members being projected outwardly of the inner bulb from the solid portion, the solid portion of the inner bulb having an outer diameter of a third value, the first and second outer pipes are connected to each other in such a manner that the solid portion of the inner bulb may be received in the small-diameter hollow part of the first outer pipe and the portion of the small-diameter hollow part of the first outer pipe surrounding the metal member projected from the solid portion of the inner bulb is deformed into the solid part, the small-diameter hollow part of the first outer pipe having an inner diameter of a fifth value which is larger than the third value so that a gap may be formed between an outer surface of the solid portion of the inner bulb and an inner surface of the small-diameter hollow portion of said outer tube.

According to another aspect, the present invention provides a method of producing a discharge tube, including the steps of: preparing an inner bulb including a hollow portion for defining therein an arc discharge chamber enclosing therein gas for emitting light, the inner bulb further including a pair of electrodes exposed in the arc discharge chamber and a pair of metal members connected to a corresponding one of the pair of electrodes in such a manner that the pair of metal members are projected outwardly of the inner bulb, the hollow portion having an outer diameter of a first value; preparing a first outer pipe having a large-diameter hollow part and a small-diameter hollow part continuously connected with each other, the small-diameter hollow part having an outer diameter of a second value which is equal to or smaller than the first value, the first outer pipe having a first and second open ends at the large-diameter hollow part and at the small-diameter hollow part, respectively; preparing a second outer pipe having a large-diameter hollow part and a small-diameter hollow part continuously connected with each other, the second outer pipe having first and second open ends at the large-diameter hollow part and at the small-diameter hollow part, respectively; connecting the first and second outer pipes, with the first open end of the first outer pipe facing the first open end of the second outer pipe, to thereby continuously connect the large-diameter hollow parts of the first and second outer pipes, in such a manner that the inner bulb may be positioned in the interior of the thus connected first and second outer pipes so that the hollow portion of the inner bulb may be received in at least one of the large-diameter hollow parts of the first and second outer pipes and the pair of metal members projected outwardly of the inner bulb may be received in the small-diameter hollow parts of the first and second outer pipes; drawing air from the interior of the thus connected first and second outer pipes through the second open ends of the first and second outer pipes; deforming portions of the small-diameter hollow parts of the first and second outer pipes surrounding the metal members projected outwardly of the inner bulb into solid parts with the metal members being embedded therein; and cutting the thus formed solid parts, to thereby obtain a discharge tube in which the inner bulb is sealingly enclosed in an outer tube in such a manner that the hollow portion of the inner bulb may be received in the large-diameter part of the outer tube and the metal members projected outwardly of the inner bulb may be received in the solid parts, with a gap being formed between an outer surface of the inner bulb and an inner surface of the outer tube.

Other objects, features and advantages of the present invention will become apparent in the following specification and accompanying drawings.

BRIEF DESCRIPTION OF THE DRAWINGS

FIG. 5(*b*) schematically illustrates a dimensional relationship between the discharge tube and the reflective mirror;

Throughout the accompanying drawings, the same or like reference numerals or characters refer to the same or like parts.

DETAILED DESCRIPTION OF PREFERRED EMBODIMENT

Figure 4A:
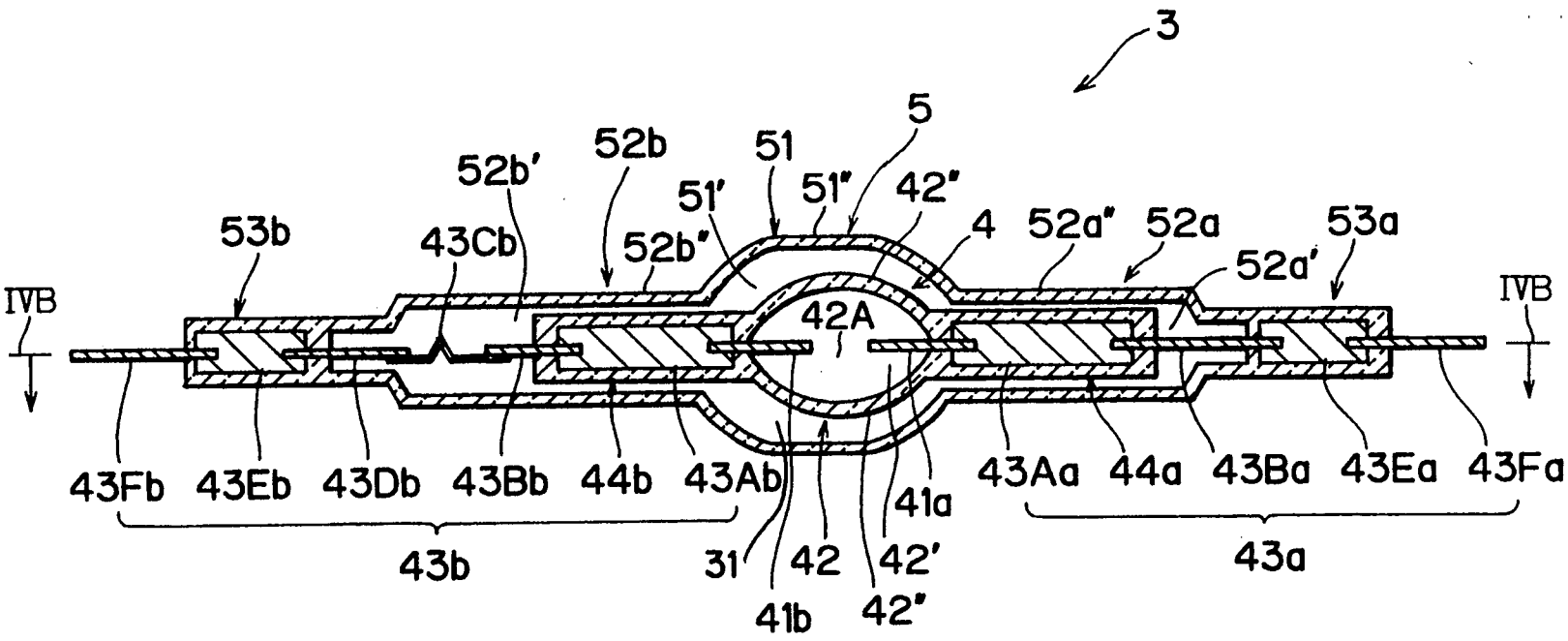
FIG. 4(*a*) and 4(*b*) schematically show a discharge tube of a preferred embodiment of the present invention, in which FIG. 4(*a*)' is a schematic side sectional view of the discharge tube and FIG. 4(*b*) is a schematic side sectional view of the discharge tube taken along a line IVb—IVb of FIG. 4(*a*)
Figure 4B:
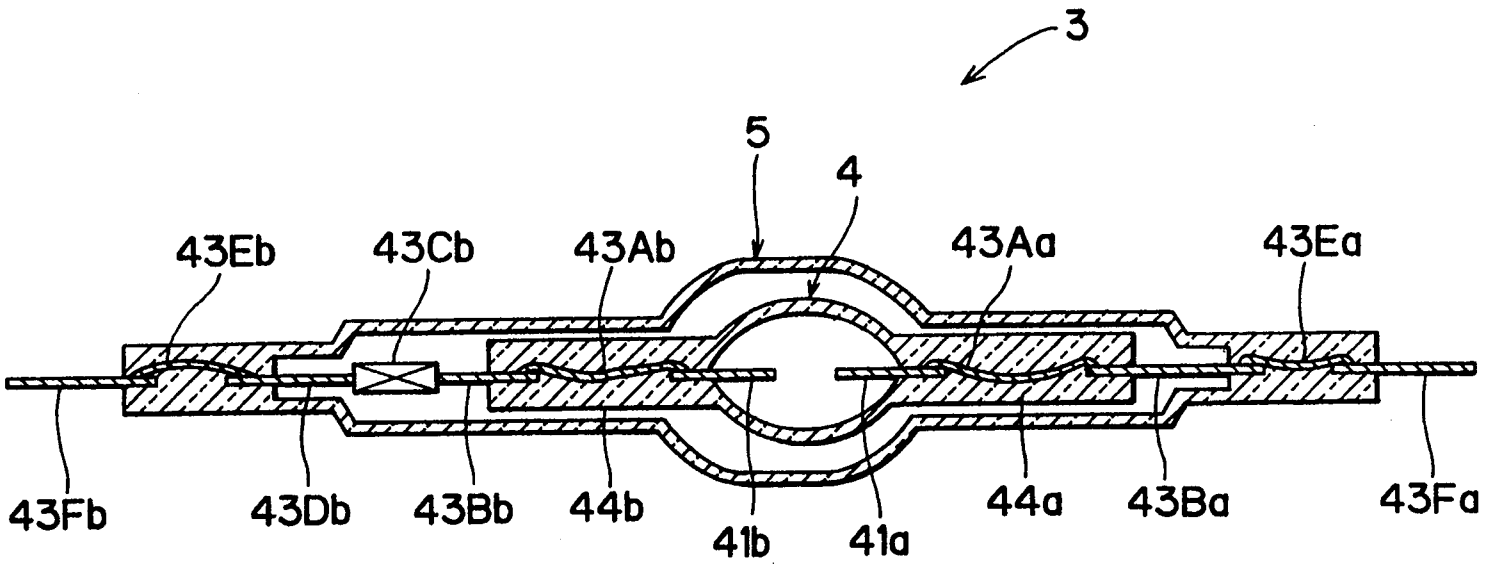
Figure 5A:
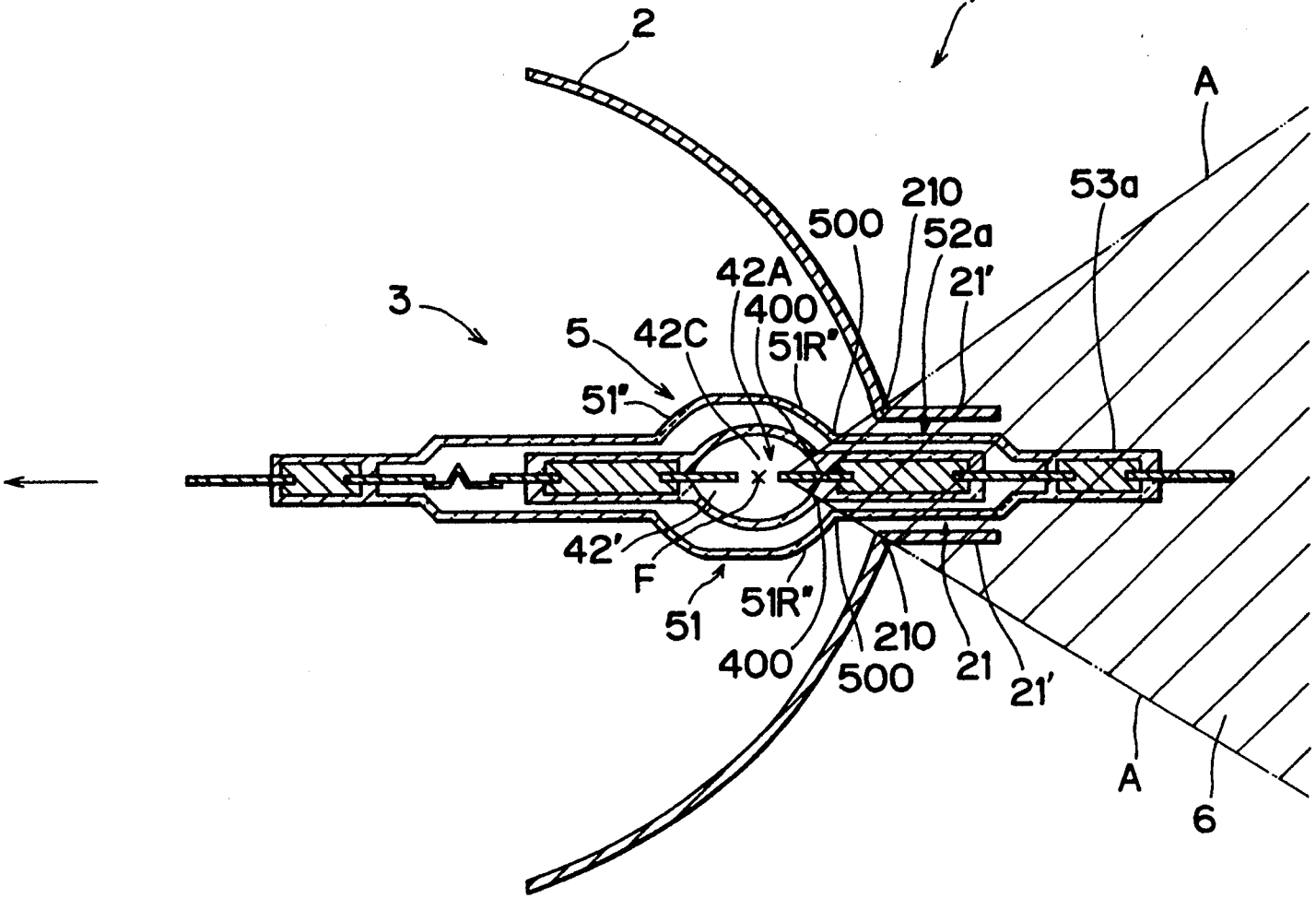
FIG. 5(*a*) is a schematic side sectional view of one example of a light source employing the discharge tube of the preferred embodiment.
Figure 5B:
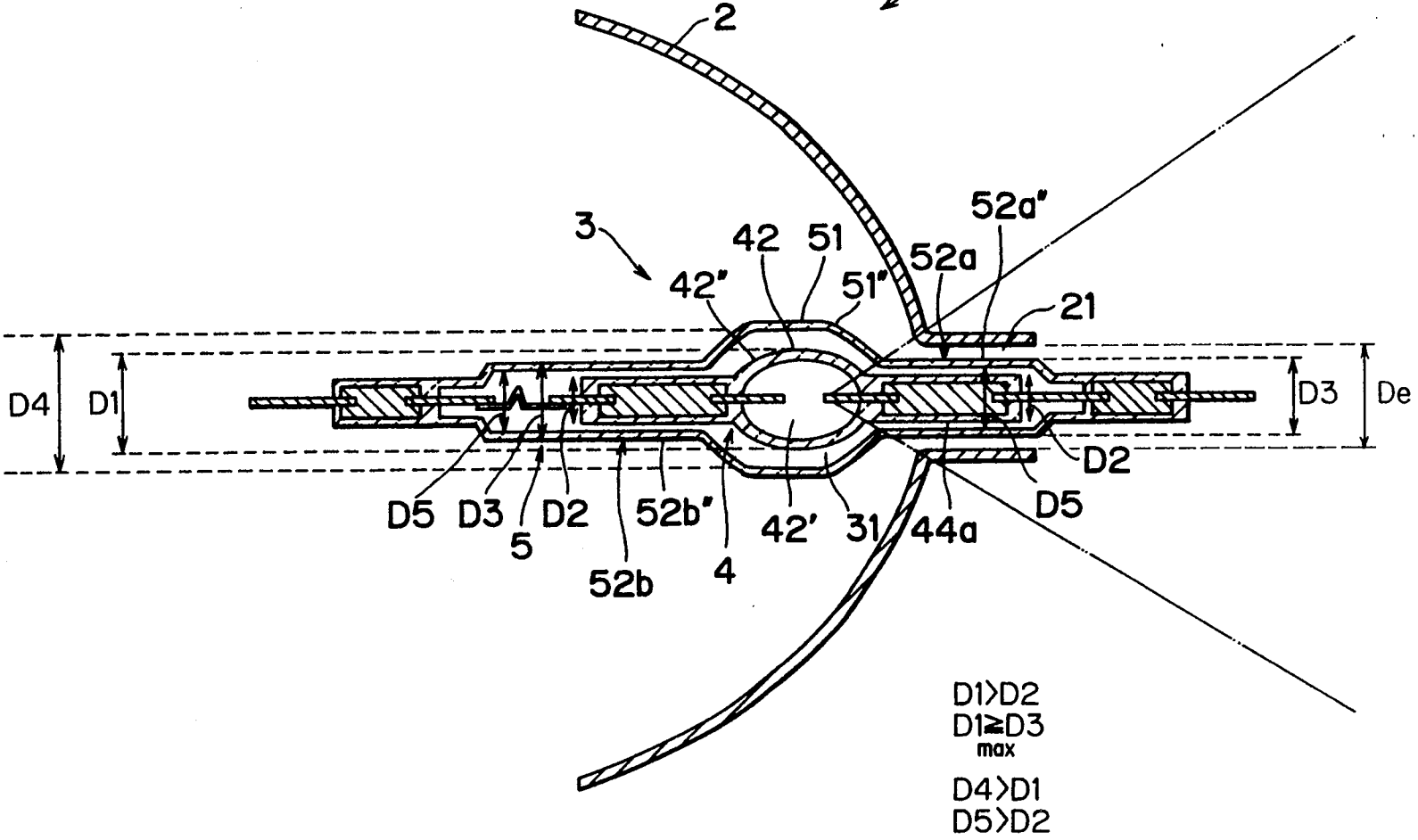

FIG. 4(*a*) and 4(*b*) illustrate a discharge tube of a preferred embodiment of the present invention, and FIGS. 5(*a*) and 5(*b*) illustrate a light source employing the discharge tube of the preferred embodiment.

The discharge tube 3 of the preferred embodiment is of the double-tube structure including an internal bulb 4 and an outer tube 5 each of which is formed of silica glass. Preferred examples of the internal bulb 4 include xenon gas discharge tube, metal vapor discharge tube, etc. The internal bulb 4 includes a spherically-shaped hollow portion 42 and a pair of cylindrically-shaped solid portions 44*a* and 44*b* in such a manner that the hollow portion 42 may be positioned between the pair of solid portions 44*a* and 44*b*. A wall 42" defining the hollow portion 42 and the solid portions 44*a* and 44*b* are formed of the silica glass and are continuously connected with one another. The hollow portion 42 is substantially of a spherical shape. More specifically, the hollow portion 42 is of an ellipsoidal spherical shape which has an ellipsoidal side cross section as shown in FIGS. 4(*a*) and 4(*b*) and which has a circular cross section taken along a plane extending perpendicular to both the planes of the surface of the sheets of FIGS. 4(*a*) and 4(*b*). The hollow portion 42 defines therein an arc discharge chamber 42' for enclosing therein xenon, argon, metal or metal halide for light emission operation. The thickness of the wall 42" of the hollow portion 42 has a small value for attaining a high light transmittance so that the intensity of light generated in the arc discharge chamber 42' is little lowered during when the light passes through the wall 42".

The solid portion 44*a* sealingly supports therein an electrode 41*a* so that one end of the electrode 41*a* may be projected therefrom to be exposed in the arc discharge chamber 42'. The solid portion 44*b* sealingly supports therein another electrode 41*b* so that one end of the electrode 41*b* may be projected therefrom to be exposed in the arc discharge chamber 42'. The electrodes 41*a* and 41*b* are formed of tungsten or the like. With such a structure, arc discharge will be generated between the tip ends of the pair of electrodes 41*a* and 41*b* inside the arc discharge chamber 42' so that light may be generated at an area 42A defined between the tip ends of the pair of electrodes 41*a* and 41*b*.

The solid portion 44*a* further sealingly supports a first metal (molybdenum) foil 43Aa connected to the electrode 41*a* and a first metal (molybdenum) rod 43Ba connected to the first metal foil 43Aa. One end of the first metal rod 43Ba is projected outside of the inner bulb 4 from the solid portion 44*a*. The solid portion 44*b* further sealingly supports a first metal (molybdenum) foil 43Ab connected to the electrode 41*b* and a first metal (molybdenum) rod 43Bb connected to the first metalfoil 43Ab. One end of the first metal rod 43Bb is projected outside of the inner bulb 4 from the solid portion 44*b*.

The outer tube 5 includes: a large-diameter cylindrically-shaped hollow portion 51; a pair of small-diameter cylindrically-shaped hollow portions 52*a* and 52*b* positioned to sandwich the large-diameter hollow portion 51 therebetween; and a pair of small-diameter cylindrically-shaped solid portions 53*a* and 53*b* which are positioned next to the hollow portions 52*a* and 52*b*, respectively. A wall 51″ of the hollow portion 51 is continuously connected to walls 52*a*″ and 52*b*″ of the hollow portions 52*a* and 52*b*, and the walls 52*a*″ and 52*b*″ are continuously connected to the solid portions 53*a* and 53*b*. The walls 51″, 52*a*″ and 52*b*″ and the solid portions 53*a* and 53*b* are all formed of silica glass. The large-diameter hollow portion 51 defines therein a large-diameter chamber 51′ and the small-diameter hollow portions 52*a* and 52*b* define therein small-diameter chambers 52*a*′ and 52*b*′, respectively. The large-diameter chamber 51′ is therefore continuously connected to the small-diameter chambers 52*a*′ and 52*b*′.

The inner bulb 4 is sealingly enclosed in the outer tube 5 in such a manner that the spherically-shaped hollow portion 42 of the inner bulb 4 may be positioned in the large-diameter chamber 51′ and the cylindrically-shaped solid portions 44*a* and 44*b* of the inner bulb 4 may be positioned in the small-diameter chambers 52*a*′ and 52*b*′, respectively, so that an outer surface of the inner bulb 4 may not be contacted with the inner surface of the outer tube 5 but an annular space 31 may be formed between the inner bulb 4 and the outer tube 5.

More specifically, the first metal (molybdenum) rod 43Ba which is projected from the solid portion 44*a* of the inner bulb 4 extends in the small-diameter chamber 52*a*′ of the outer tube 5 to be sealingly inserted into the solid portion 53*a* of the outer tube 5. Another first metal (molybdenum) rod 43Bb projected from the solid portion 44*b* of the inner bulb 4 extends in the small-diameter chamber 52*b*′ of the outer tube 5 to be connected to a metal (nickel) buffer wire 43Cb which is connected to a second metal (molybdenum) rod 43Db which is sealingly supported in the solid portion 53*b* of the outer tube 5. Accordingly, the inner bulb 4 is supported by the pair of solid portions 53*a* and 53*b* of the outer tube 5 via the first molybdenum rod 43Ba and the other first molybdenum rod 43Bb, the nickel buffer wire 43Cb and the second molybdenum rod 43Db. Accordingly, the inner bulb 4 is held in the interior of the outer tube 5 in such a state that any point of the outer surface of the wall 42″ and the solid portions 44*a* and 44*b* of the inner bulb 4 may not be contacted to any point of the inner surfaces of the walls 51″, 52*a*″ and 52*b*″ and the solid portions 53*a* and 53*b*.

The solid portion 53*a* of the outer tube 5 sealingly supports a second metal (molybdenum) foil 43Ea connected to the first metal rod 43Ba and a third metal (molybdenum) rod 43Fa connected to the second metal foil 43Ea in such a manner that the third metal rod 43Fa may be projected outside of the outer tube 5 from the solid portion 53*a*. The solid portion 53*b* of the outer tube 5 further sealingly supports a second metal (molybdenum) foil 43Eb connected to the second metal rod 43Db and a third metal (molybdenum) rod 43Fb connected to the second metal foil 43Eb in such a manner that the third metal rod 43Fb may be projected outside of the outer tube 5 from the solid portion 53*b*. The third metal rods 43Fa and 43Fb thus projected outside of the outer tube 5 will be connected to an electric power supply (not shown in the drawing) so that electric current may be supplied to the pair of electrodes 41*a* and 41*b*. In other words, the metal rod 43Fa, the metal foil 43Ea, the metal rod 43Ba and the metal foil 43Aa cooperate with one another to serve as a lead wire 43*a* for electrically connecting the electrode 41*a* to the electric power supply. The metal rod 43Fb, the metal foil 43Eb, the metal rod 43Db, the metal buffer wire 43Cb, the metal rod 43Bb and the metal foil 43Ab cooperate with one another to serve as another lead wire 43*b* for electrically connecting the electrode 41*b* to the electric power supply.

Thus, the molybdenum rods (43Ba, 43Bb, 43Db) and the nickel buffer wire (43Cb) extending in the space 31 and the molybdenum rods (43Fa, 43Fb) extending outside of the outer tube 5 and the molybdenum foils (43Aa, 43Ab, 43Da, 43Eb) embedded in the solid portions (44*a*, 44*b*, 53*a*, 53*b*) are combined with one another to constitute the lead wires 43*a* and 43*b* for electrically connecting the discharge tube 3 to the electric power supply. According to the present invention, the molybdenum foils are thus embedded in the solid portions for constituting the lead wires, for the following reason: When each of the inner bulb 4 and the outer tube 5 is to be produced, a silica glass pipe or tube is thermally softened to be deformed into each solid portion with the molybdenum foil being maintained therein. When the silica glass pipe is thus thermally softened, the glass pipe is thermally expanded and shrunk, so that ununiform stress is generated within the glass. In such a case, if only a metal rod or wire is to be embedded in the solid portion, due to the ununiform stress generated in the glass, cracks will erroneously occur in the formed solid portion, and an undesired gap or space will be formed in the solid portion around the metal rod. Thus, the formed undesired gap will erroneously decrease the vacuum degree of the inside of the produced inner bulb 4 or the produced outer tube 5. According to the present invention, however, not only the molybdenum rod but also the molybdenum foil are embedded in the solid portion. The molybdenum foil serves to restrain thermal expansion of the portion of the glass which is contacted with the molybdenum foil, to thereby prevent cracks from occurring in the formed solid portion. Thus, an undesired gap or space will not be formed in the solid portion around the molybdenum foil.

The metal buffer wire 43Cb is of a spring shape and is provided to absorb stress occurring due to heat which is generated in the gap 31 at the time when the arc discharge is generated in the arc discharge chamber 42′.

The interior of the outer tube 5. (i.e., the chambers 51′, 52*a*′ and 52*b*′) is in a vacuum state. Or otherwise, the outer tube 5 encloses, in the chambers 51′, 52*a*′ and 52*b*′, a small amount of nitrogen or inert gas such as argon, krypton, neon, xenon, or the like which will serve to prevent oxidization of the metal rods 43Ba, 43Bb and 43Db and the metal buffer wire 43Cb which are exposed in the chambers 52*a*′ and 52*b*′. As described above, since the inner bulb 4 is supported in the outer tube 5 in such a manner that the outer surface of the inner bulb 4 may not be contacted with the inner surface of the outer tube 5, there is formed the annular gap 31 between the outer surface of the inner bulb 4 and the inner surface of the outer tube 5. Accordingly, the gap 31 is brought into the vacuum state or is filled with the small amount of inert gas, so that the inner bulb 4 is thermally insulated from the atmospheric air outside of the discharge tube 3. Accordingly, the heat accumulation capacity of the inner bulb is enhanced, so that the lowering of the light transmittance of the wall 42″ of the inner bulb 4 due to the matter sputtered thereon is restrained, and the lifetime of the discharge tube is enhanced.

When a light source 1 is produced with the use of the discharge tube 3 having the above-described structure, the discharge tube 3 is attached to the reflective mirror 2, as shown in FIG. 5(*a*). (In the following description, the direction indicated by an arrow in FIG. 5(*a*) (leftward direction in FIG. 5(*a*)) is referred to as a forward direction.) The reflective mirror 2 is of a bowl-shape having a parabolic inner mirror surface. The bowl-shaped reflective mirror 2 is formed with an access through-hole 21 for receiving therein the small-diameter hollow portion 52*a*of the outer tube 5 of the discharge tube 3. In other words, when the discharge tube 3 is to be combined with the reflective mirror 2 to produce the light source 1, the solid portion 53*a* of the discharge tube 3 is first inserted into the access through-hole 21 of the reflective mirror 2 along an inner wall 21′ of the reflective mirror 2 which defines therein the access through-hole 21, and then the small-diameter hollow portion 52*a* is fitted to the access through-hole 21 at such a position as allowing the center position 42C of the arc discharge chamber 42′ which corresponds to the center position of the light emitting area 42A to coincide with a focal point F of the parabolic mirror surface of the reflective mirror 2.

It is noted that there may occur a problem in the case where a distance between a front edge portion 500 of the small-diameter hollow portion 52*a* (a boundary portion defined between the large-diameter hollow portion 51 and the small-diameter hollow portion 52*a*) and the center position of the light emitting area 42A is too large. In this case, it is impossible to position the center position 42C of the light emitting area 42A at the focal point F of the reflective mirror 2, even if the discharge tube 3 is inserted into the access through-hole 21 as deep as possible along the inner wall 21′ to such a degree that the rear side 51R″ of the wall 51″ of the large-diameter hollow portion 51 of the outer tube 5 is brought into abutment contact with the inner mirror surface of the reflective mirror 2. In order to solve the problem, the discharge tube 3 of the present invention is so designed as to have a relative dimension satisfying the following inequality with respect to the reflective mirror 2, as shown in FIG. 6.

$$L1 < Fr + (La/2)$$

Figure 6:
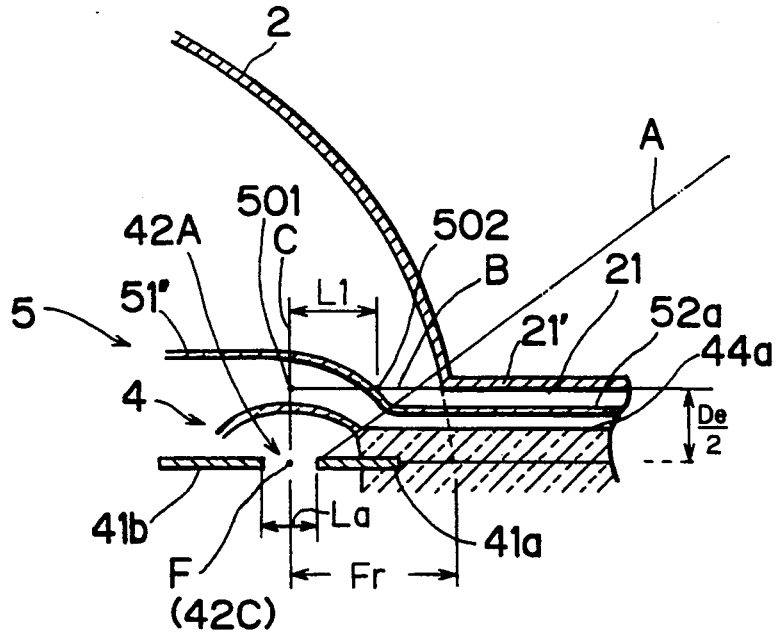
FIG. 6 schematically illustrates a positional relationship between the focal point F of the reflective mirror and the discharge tube.

In FIG. 6, an imaginary line B is defined as a line which extends parallel to axes of the electrodes 41*a* and 41*b* and which is apart from the electrode axes with a distance of (De/2), where De is a diameter of the access through-hole 21 of the reflective mirror 2. In other words, the imaginary line B extends from the front edge of the inner wall 21′ of the reflective mirror 2 parallel to the electrode axes. L1 is defined as a distance between an intersection point 501 between the imaginary line B and an imaginary line C which extends from the center position 42C of the light emitting area 42A perpendicularly to the axes of the electrodes (41*a*, 41*b*) and another intersection point 502 between an outer surface of the wall 51″ of the outer tube 5 and the imaginary line B. La is defined as a distance between tip ends of the electrodes 41*a* and 41*b* facing each other. Fr is a focal length defined as a distance between the focal point F and a basis point of the inner mirror surface of the reflective mirror 2.

Since the discharge tube 3 of the present invention has the above-described dimensional relationship with respect to the reflective mirror 2, it becomes certainly possible to attach the discharge tube 3 to the reflective mirror 2 at such a position that the center position 42C of the light emitting area 42A of the discharge tube may be positioned exactly on the focal point F of the inner mirror surface. Accordingly, the light generated in the arc discharge chamber 42 proceeds directly forwardly (leftwardly in FIG. 5(*a*)) or proceeds rearwardly (rightwardly in the FIG. 5(*a*)) to be reflected at the mirror surface of the reflective mirror 2 to thereby proceed forwardly. Thus, the light source 1 of the present invention may effectively and fully introduce the light generated in the arc discharge chamber 42′ onto an LC display panel which is positioned forwardly of the light source 1.

The dimensional relationship between the inner bulb 4 and the outer tube 5 and the reflective mirror 2 will be described in greater detail hereinafter, with reference to FIG. 5(*b*).

An inner diameter D4 of each circular cross section of the large-diameter hollow portion 51 of the outer tube 5 is selected to be larger than an outer diameter D1 of a corresponding circular cross section of the spherically-shaped hollow portion 42 of the inner bulb 4 so that the outer surface of the wall 42″ of the spherically-shaped hollow portion 42 may not be contacted with the inner surface of the wall 51″ of the large-diameter hollow portion 51. Similarly, an inner diameter D5 of each circular cross section of the small-diameter hollow portions 52*a* and 52*b* of the outer tube 5 is selected to be larger than an outer diameter D2 of a corresponding circular cross section of the solid portions 44*a* and 44*b* so that the outer surface of the solid portions 44*a* and 44*b* may not be contacted with the inner surface of the walls 52*a*″ and 52*b*″ of the hollow portions 52*a* and 52*b*. Accordingly, the already-described annular gap 31 is formed between the outer surface of the inner bulb 4 and the inner surface of the outer tube 5, for completely thermally insulating the inner bulb 4 from external outside of the discharge tube 3.

Furthermore, the outer diameter D1 of each cross section of the spherically-shaped hollow portion 42 of the inner bulb 4 is selected to be larger than the outer diameter D2 of the cylindrically-shaped solid portions 44*a* and 44*b* of the inner bulb 4.

In addition, the spherically-shaped hollow portion 42 has a maximum outer diameter portion whose outer diameter D1max is selected to be equal to or larger than an outer diameter D3 of the small-diameter hollow portion 52*a* of the outer tube 5 which is to be inserted into the access through-hole 21 of the reflective mirror 2. The outer diameter D3 of the small-diameter hollow portion 52*a* is almost equal to or slightly smaller than an inner diameter De of the access through-hole 21 of the reflective mirror 2 so that the small-diameter hollow portion 52*a* may be inserted into and fitted to the access through-hole 21. Since the discharge tube 3 and the reflective mirror 2 have the above-described relative dimensions with respect to each other, the area of the access through-hole 21 facing the arc discharge chamber 42′ of the inner bulb 4 where light emission is occurred is relatively small with respect to the volume of the arc discharge chamber 42′. Accordingly, it becomes possible to decrease the ratio, with respect to the total amount of the light generated in the arc discharge chamber 42', of the amount of the light reaching the access through-hole 21 which is not to be reflected by the reflective mirror 2. In other words, the light source 1 of the present invention can effectively introduce the light generated in the arc discharge chamber 42' onto the LC display positioned forwardly of the light source 1.

Though the inner diameter De of the access through-hole 21 (i.e., the outer diameter D3 of the small-diameter hollow portion 52*a*) preferably has a small value as described above, it is unnecessary to select the outer diameter D3 (the inner diameter De) to have so small of a value, for the following reason: It is noted that a shadow space area 6 may be defined for the discharge tube 3 as a space area in which the intensity of light propagated therein is remarkably attenuated. It is therefore unnecessary to reflect, with the reflective mirror, the light which have been propagated through the shadow space area 6 and which has the lowered intensity. Accordingly, the discharge tube 3 should preferably be attached to the reflective mirror 2 so that the access through-hole 21 of the reflective mirror 2 may be positioned within the shadow space area 6. In view of this, it is sufficient that the outer diameter D3 of the small-diameter hollow portion 52*a* (i.e., the inner diameter De of the access through-hole) should be selected to such a value that the access through-hole 21 may be positioned within the shadow space area 6, but it is unnecessary to select the outer diameter D3 (the inner diameter De) to have so small of a value.

The shadow space area 6 will be described in greater detail hereinafter. The shadow space area 6 may be determined dependently on the structure and the kind of material of the inner bulb 4 and the outer tube 5 of the discharge tube 3.

Figure 7:
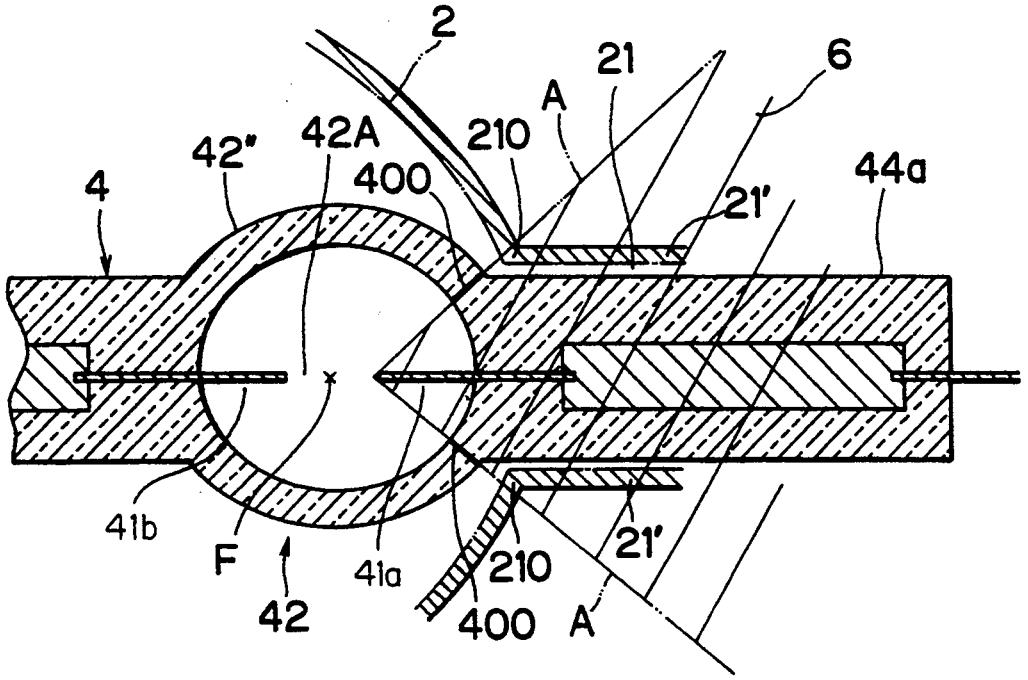
FIG. 7 schematically illustrates the state how the inner bulb of the discharge tube is positioned relative to the access through-hole of the reflective mirror, where the outer tube is neglected from the drawing for clarity and simplicity.

For example, the thickness of the solid portion 44*a* of the inner bulb 4 is considerably larger than the thickness of the wall 42'' of the spherically-shaped hollow portion 42, as schematically shown in FIG. 7. With such a structure, when the light generated in the arc discharge chamber 42' is emitted obliquely rearwardly (rightwardly in the drawing) to be propagated in the solid portion 44*a*, the intensity of the light will be considerably attenuated. In other words, the light transmittance of the solid portion 44*a* is remarkably low relative to the wall 42'' of the spherically-shaped hollow portion 42. Accordingly, in the light source 1, the shadow space area 6 (depicted by slanted line) is defined as a cone-shaped space defined by an imaginary line A, as a generating line of the cone-shape, which connects the tip end of the electrode 41*a* and a boundary point 400 between the wall 42'' of the spherically-shaped hollow portion 42 and the solid portion 44*a*. Since the light transmittance of the solid portion 44*a* is low as described above, the intensity of the light which has been propagated in the shadow space area 6 is inherently low. Accordingly, it is unnecessary to reflect the light which has been propagated in the shadow space area 6 with the reflective mirror 2. Therefore, according to the present invention, the discharge tube 3 is preferably attached to the reflective mirror 2 at such a position that the access through-hole 21 may be positioned completely within the shadow space area 6 of the discharge tube 3. In other words, the discharge tube 3 is preferably attached to the reflective mirror 2 at such a position that the front edge 210 of the inner wall 21' may be positioned within the cone-shaped shadow space area 6 of the discharge tube 3.

Figure 8:
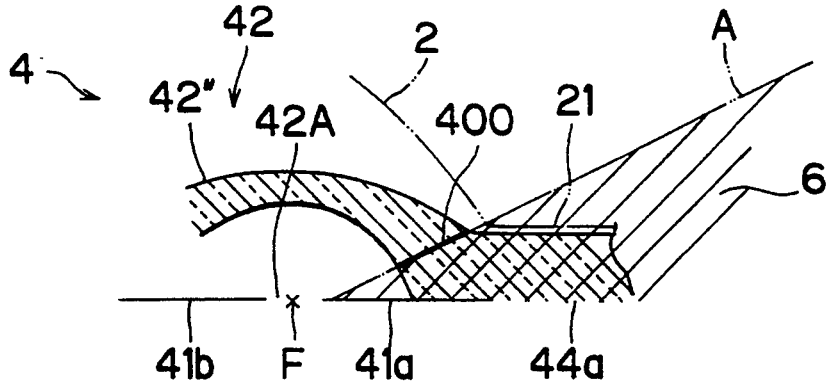
FIG. 8 schematically illustrates the state how the inner bulb of the discharge tube is positioned relative to the access through-hole of the reflective mirror, in the case where the thickness of the wall of the spherically-shaped hollow portion has an ununiform value, where the outer tube is neglected from the drawing for clarity and simplicity.

In the case where the wall 42'' of the spherically-shaped hollow portion 42 of the inner bulb 4 is so designed as to have an ununiform thickness for attaining a lens function, as shown in FIG. 8, since the thickness of the solid portion 44*a* is still much larger than the thickness of the wall 42'', the discharge tube 3 should be preferably attached to the reflective mirror 2 at such a position that the access through-hole 21 may be positioned completely within the cone-shaped shadow space area 6 defined by the imaginary line A, as a generating line, which connects the tip end of the electrode 41*a* and the boundary point 400 between the wall 42'' and the solid portion 44*a*, similarly as described above.

Accordingly, the outer diameter D3 of the small-diameter hollow portion 52*a* of the outer tube 5 which determines the inner diameter of the access through-hole 21 should be determined dependently on the shadow space area 6 which is determined on the structure of the inner bulb 4, i.e., the positional relationship between the tip end of the electrode 41*a* and the boundary portion 400 between the hollow portion 42 and the solid portion 44*a*.

Figure 9:
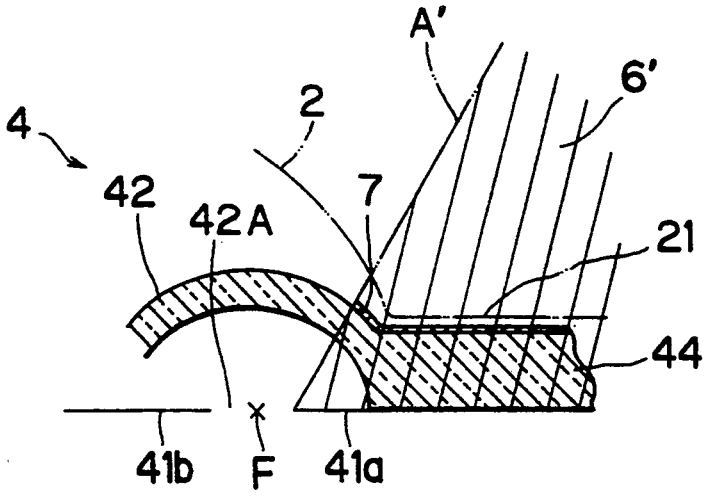
FIG. 9 schematically illustrates the state how the inner bulb of the discharge tube is positioned relative to the access through-hole of the reflective mirror, in the case where the inner bulb is covered with the light-shielding film, where the outer tube is neglected from the drawing for clarity and simplicity.

In the case where the outer surface of the wall 42'' of the hollow portion 42 and the outer surface of the solid portion 44*a* of the inner bulb 4 is covered with a light-shielding film 7 (formed of ceramic or the like) for thermally insulating the inner bulb 4, as shown in FIG. 9, the cone-shaped shadow space area 6' (depicted by slanted lines) is now defined by an imaginary line A', as a generating line, which connects the tip end of the electrode 41*a* and a front end of the light-shielding film 7. In this case, therefore, the discharge tube 3 should be preferably attached to the reflective mirror 2 at such a position that the access through-hole 21 may be positioned completely within the shadow space area 6'.

Figure 10A:
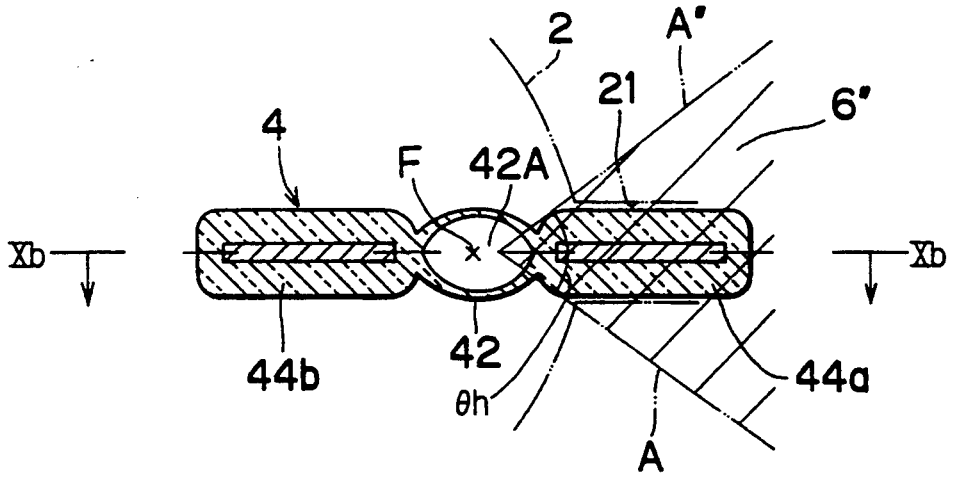
FIGS. 10(*a*) and 10(*b*) schematically illustrate the state how the inner bulb of the discharge tube is positioned relative to the access through-hole of the reflective mirror, in the case where the inner bulb has a flat-shaped cross section, where the outer tube is neglected from the drawing for clarity and simplicity, in which FIG. 10(*a*) is a cross-sectional side view of the inner bulb and the reflective mirror and FIG. 10(*b*) is a cross-sectional side view of the inner bulb and the reflective mirror taken along a line Xb—Xb of FIG. 10(*a*)
Figure 10B:
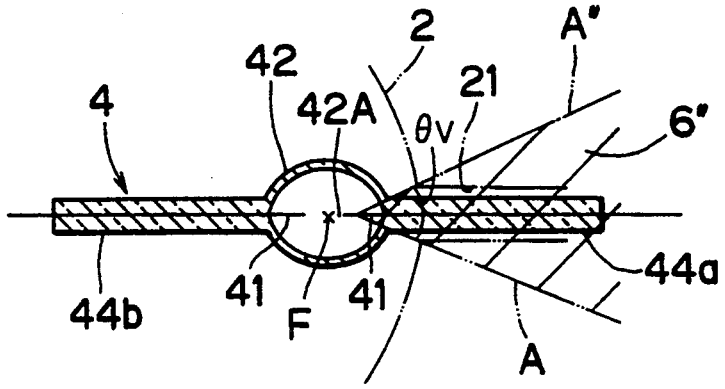

Though the above description is directed to such an inner bulb 4 as having a circular cross section, the inner bulb 4 may have a flat cross section as shown in FIGS. 10(*a*) and 10(*b*). (Such an inner bulb 4 as having a flat cross section may be produced through a pinch sealing process.) In the inner bulb 4 having such a flat cross section, a spreading angle $\theta h$ of the shadow space area 6'' along a plane extending along the sheet of FIG. 10(*a*) is different from another spreading angle $\theta v$ of the shadow space area 6'' along another plane extending along the sheet of FIG. 10(*b*). For the inner bulb 4 having the flat cross section, such an outer tube 5 as also having a flat cross section is preferably provided for enclosing therein the inner bulb 4 to produce the discharge tube 3. A reflective mirror 2 having such an access through-hole 21 as having a flat cross section is preferably combined with the discharge tube 3.

Though a parabolic reflective mirror is used as the reflective mirror 2 in the above description, an ellipsoidal reflective mirror, a hyperboloidal reflective mirror or the like may be used, in place of the parabolic mirror. Furthermore, the discharge tube 3 may be integrally combined with the reflective mirror 2.

As described above, the discharge tube 3 of the double-tube structure type of the present embodiment may attain an improved heat accumulation property, since the inner bulb 4 is supported in the outer tube 5 only via the lead wires 43*a* and 43*b* and no part of the inner bulb 4 is contacted with the inner surface of the outer tube 5. Accordingly, it becomes possible to increase the volume of the inner bulb 4, i.e., the volume of the arc discharge chamber 42', to thereby effectively prevent the inner surface of the wall 42'' of the spherically-shaped hollow portion 42 from being attached with spattered matter. As a result, it becomes possible to increase a life time of the discharge tube.

According to the present invention, the outer diameter D3 of the small-diameter hollow portion 52*a* of the outer tube 5 to be inserted into the access through-hole 21 of the reflective mirror 2 is selected to be equal to or smaller than the maximum outer diameter D1max of the spherically-shaped hollow portion 42 of the inner bulb 4. It is therefore possible to select the inner diameter of the access through-hole 21 of the reflective mirror 2 to be small relative to the arc discharge chamber 42' of the inner bulb 4 where light emission is occurred. Accordingly, in the light source 1 constructed by the discharge tube 3 and the reflective mirror 2, it becomes possible to decrease a ratio, with respect to the total amount of the light generated in the arc discharge chamber 42', of the amount of the light radiated into the access through-hole 21. It becomes therefore possible to effectively introduce the light generated in the arc discharge chamber 42' forwardly of the light source.

The discharge tube 3 is combined with the reflective mirror 2 into the light source 1 in such a manner that the access through-hole 21 may be positioned completely within the shadow space area of the discharge tube 3. Accordingly, it becomes possible to decrease a loss of the intensity of the light as small as possible to such an amount that inherently occurs due to the structure of the discharge tube 3. Thus, according to the light source of the present invention, it becomes possible to effectively introduce light onto the LC display panel with a low amount of light intensity loss so that a large intensity of light may be irradiated on the LC display.

Though the above-describe discharge tube 3 of the present invention may be produced through various manners, one preferred example of the method of producing the discharge tube 3 will be described hereinafter.

Figure 11A:
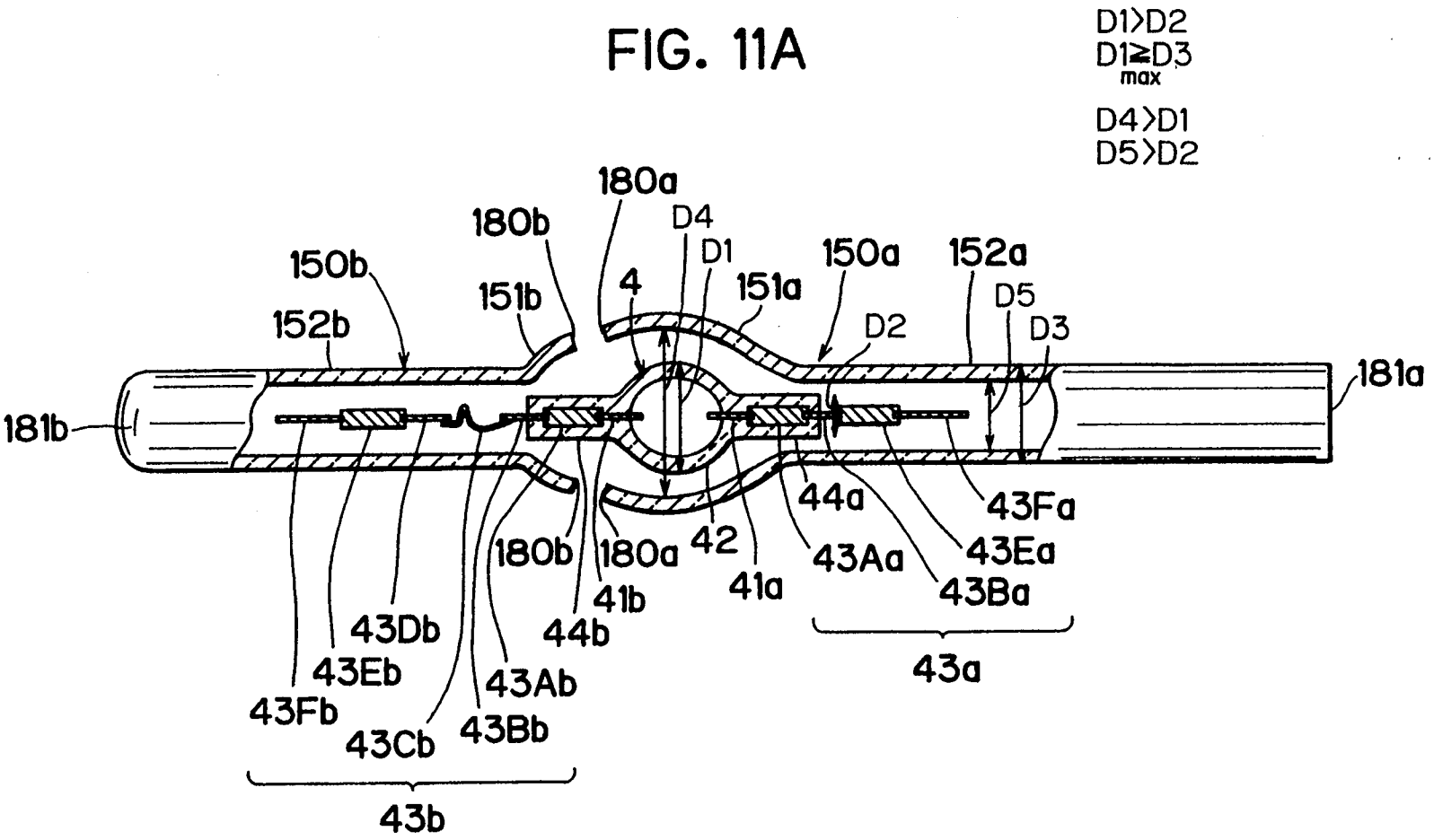
FIG. 11(*a*) through 11(*c*) schematically illustrate the method of producing the discharge tube of the preferred embodiment, in which FIG. 11(*a*) illustrates the manner how the inner bulb is inserted in the outer pipes, FIG. 11(*b*) illustrates the manner how the air in the outer pipes is drawn out, and FIG. 11(*c*) illustrates the manner how the solid portions of the outer tube is formed to thereby produce the outer tube.
Figure 11B:
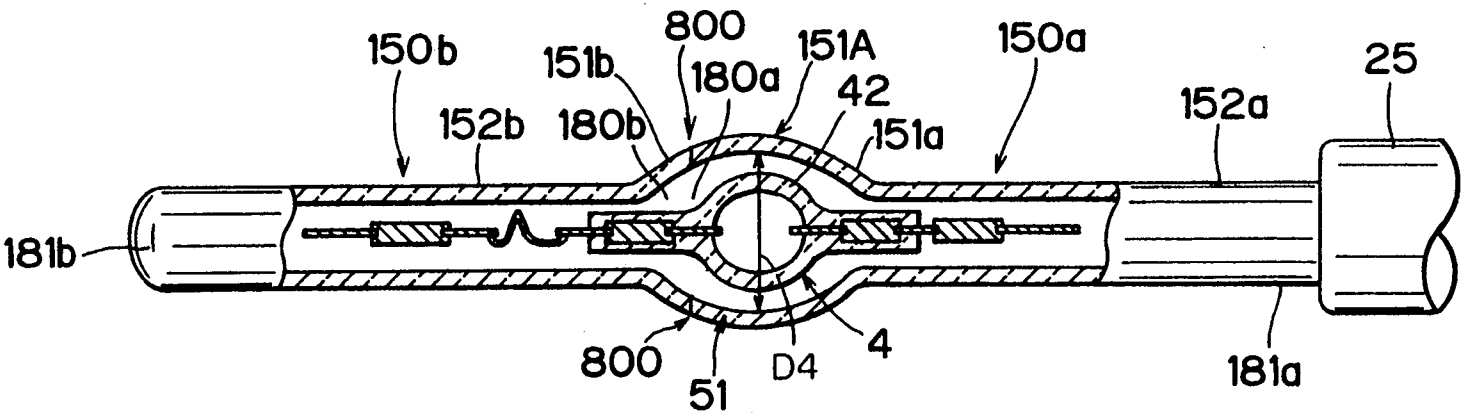
Figure 11C:
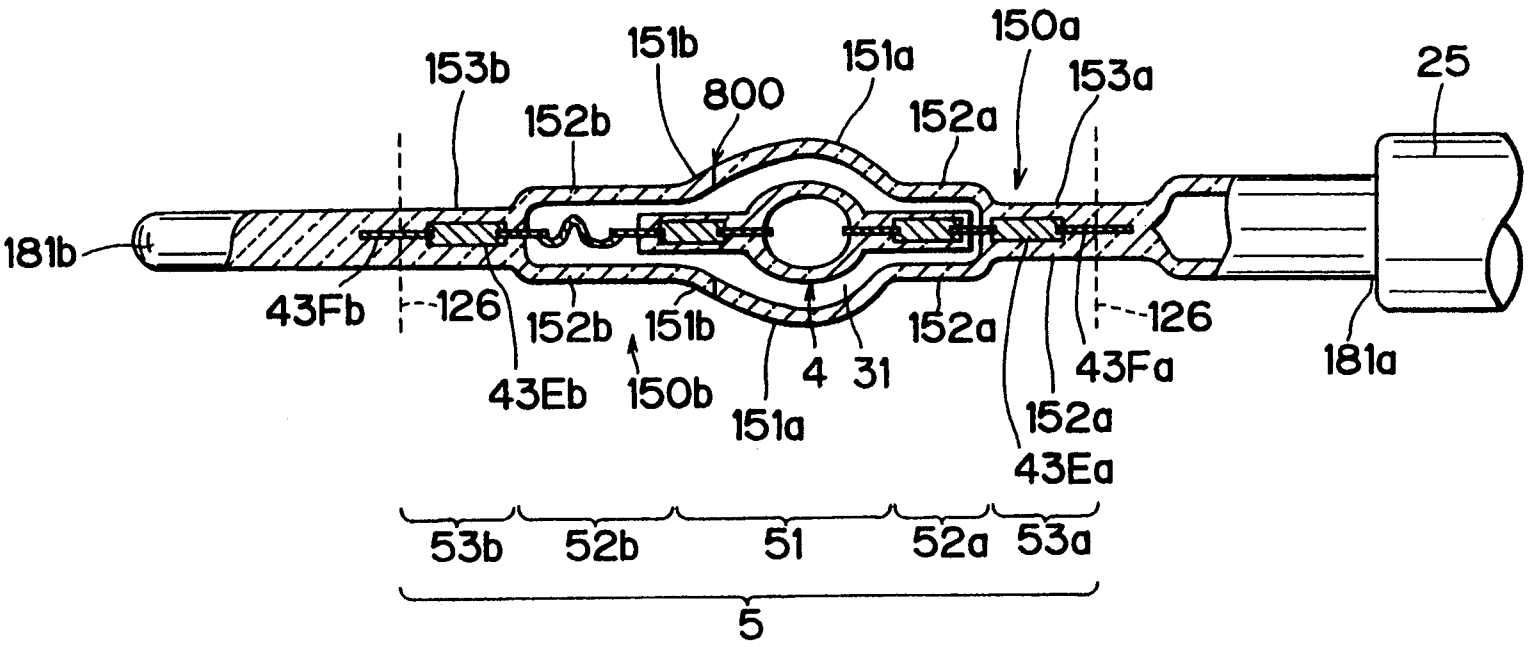

First, as shown in FIG. 11(*a*), the inner bulb 4 formed of silica glass and provided with the lead wire 43*a* (the electrode 41*a*, the foil 43Aa, the rod 43Ba, the foil 43Ea and the rod 43Fa) and the lead wire 43*b* (the electrode 41*b*, the foil 43Ab, the rod 43Bb, the buffer wire 43Cb, the rod 43Db, the foil 43Eb and the rod 43Fb) is prepared.

Then, first and second outer pipes 150*a* and 150*b* formed of silica glass are prepared. As shown in FIG. 11(*a*), the first outer pipe 150*a* includes a first large-diameter hollow part 151*a* and a small-diameter hollow part 152*a* which are continuously connected with each other. The first outer pipe 150*a* is formed with opposed open ends 180*a* and 181*a* which are defined on the large-diameter hollow part 151*a* and the small-diameter hollow part 152*a*, respectively. Similarly, the second outer pipe 150*b* includes a first large-diameter hollow part 151*b* and a small-diameter hollow part 152*b* which are continuously connected with each other. The second outer pipe 150*b* is formed with an open end 180*b* and a closed end 181*b* opposed with each other which are defined on the large-diameter hollow part 151*b* and the small-diameter hollow part 152*b*, respectively.

As will be described later, the first and second large-diameter hollow parts 151*a* and 151*b* of the first and second outer pipes 150*a* and 150*b* will be continuously connected with each other at their open ends 180*a* and 180*b*, so as to constitute the large-diameter hollow portion 51 of the outer tube 5. Accordingly, the inner diameter D4 of the first and second large-diameter hollow parts 151*a* and 151*b* is selected to be larger than the outer diameter D1 of the spherically-shaped hollow portion 42 of the inner bulb 4. The small-diameter hollow part 152*a* of the first outer pipe 150*a* will constitute the small-diameter hollow portion 52*a* of the outer tube 5, and the small-diameter hollow part 152*b* of the second outer pipe 150*b* will constitute the small-diameter hollow portion 52*b* of the outer tube 5. Accordingly, the inner diameter D5 of the first and second small-diameter hollow parts 152*a* and 152*b* is selected to be larger than the outer diameter D2 of the solid portions 44*a* and 44*b* of the inner bulb 4. In addition, the outer diameter D3 of the small-diameter parts 152*a* and 152*b* of the first and second outer pipes 150*a* and 150*b* is equal to or smaller than the maximum outer diameter D1max of the spherically-shaped hollow portion 42 of the inner bulb 4.

As will be described later, the small-diameter hollow parts 152*a* and 152*b* of the first and second outer pipes 150*a* and 150*b* will be partly thermally softened to be deformed into the small-diameter solid portions 53*a* and 53*b* of the outer tube 5.

Then, the lead wire 43*a*, the solid portion 44*a* and the spherically-shaped hollow portion 42 are inserted, in this order, into a first outer pipe 150*a* through the open end 180*a*. Simultaneously, the lead wire 43*b* and the solid portion 44*b* are inserted, in this order, into the second outer pipe 150*b* through the open end 180*b*. Thus, the first outer pipe 150*a* and the second outer pipe 150*b* are positioned so that the open end 180*a* of the first outer pipe 150*a* may confront the open end 180*b* of the second outer pipe 150*b*. Then, the first and second outer pipes 150*a* and 150*b* are moved toward each other so that peripheral edges of the open ends 180*a* and 180*b* may be brought into abutment contact with each other. Then, the open ends 180*a* and 180*b* thus contacted with each other are thermally softened so that the first and second outer pipes 150*a* and 150*b* are joined with each other at their open ends 180*a* and 180*b*, as shown in FIG. 11(*b*). In other words, the first and second outer pipes 150*a* and 150*b* are integrally joined with each other, at their open ends 180*a* and 180*b*.

As a result, the first and second large-diameter hollow parts 151*a* and 151*b* of the first and second outer pipes 150*a* and 150*b* are continuously connected with each other at their open ends 180*a* and 180*b*, so as to constitute the large-diameter hollow portion 51 of the outer tube 5. The spherically-shaped hollow portion 42 of the inner bulb 4 is positioned in the thus formed large-diameter hollow portion 51. The solid portion 44*a* and the lead wire 43*a* are positioned in the small-diameter hollow part 152*a* of the outer pipe 150*a*, and the solid portion 44*b* and the lead wire 43*b* are positioned in the small-diameter hollow part 152*a* of the outer pipe 150*a*.

It is noted that, as described already, the maximum outer diameter D1max of the spherically-shaped hollow portion 42 of the inner bulb 4 is selected to be larger than the outer diameter of the small-diameter parts 152*a* and 152*b* of the first and second outer pipes 150*a* and 150*b*. In other words, the maximum outer diameter D1max of the spherically-shaped hollow portion 42 is larger than the outer diameter D2 of the small-diameter parts 152*a* and 152*b*. According to the present invention, the inner bulb 4 is inserted into the first and second outer pipes 150*a* and 150*b* from their open ends 180*a* and 180*b* which are formed on their large-diameter hollow portions 151*a* and 151*b*. That is, the inner bulb 4 is not inserted into the first and second outer pipes 150*a* and 150*b* from their small-diameter hollow portions 152*a* and 152*b*. Accordingly, even though the maximum outer diameter of the spherically-shaped hollow portion 42 is larger than the diameter of the small-diameter hollow portions 152*a* and 152*b*, it is possible to insert the inner bulb 4 into the first and second outer pipes 150*a* and 150*b*.

Figure 1:
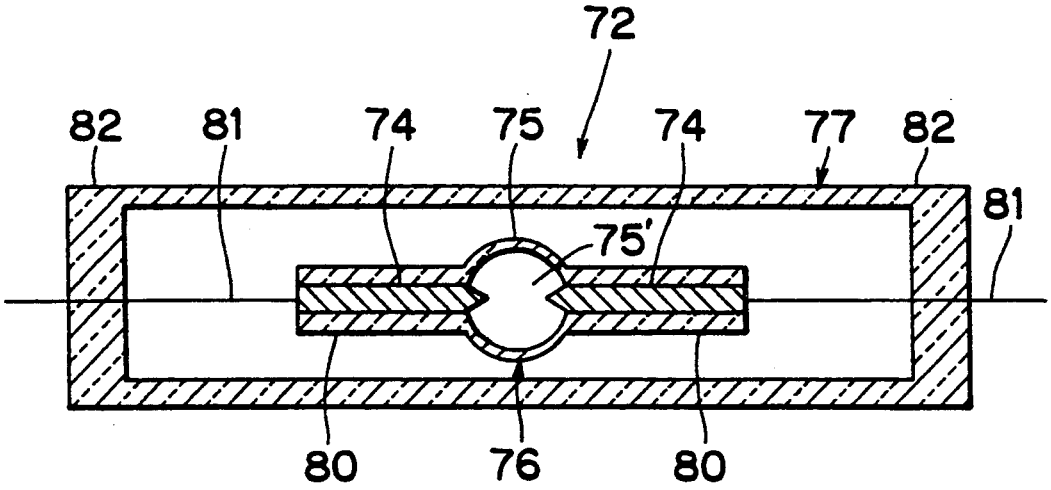
FIG. 1 PRIOR ART
FIG. 1 is a schematic side sectional view of a conventional discharge tube of a double-tube structure.
Figure 2:
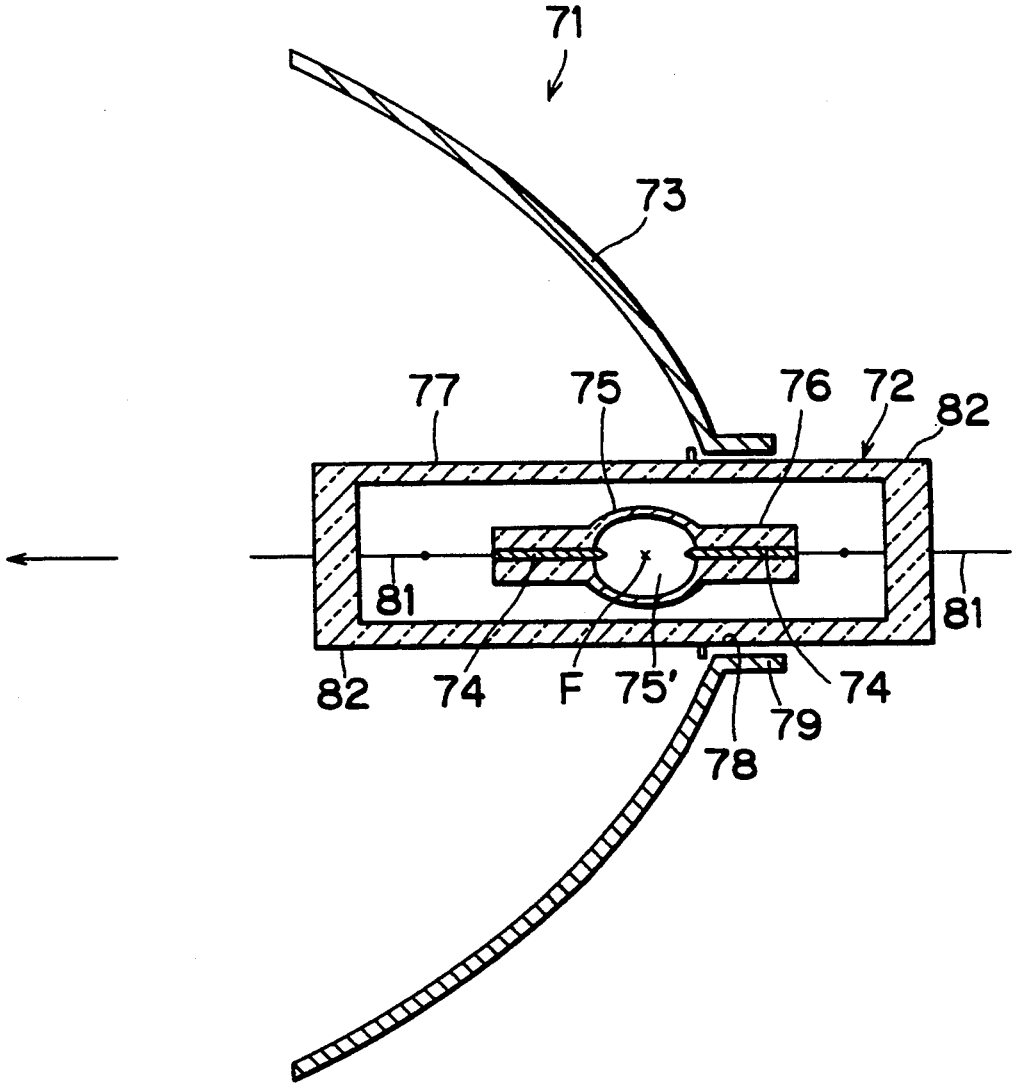
FIG. 2 PRIOR ART
FIG. 2 is a schematic side sectional view of a conventional light source employing the conventional discharge tube of FIG. 1.
Figure 3:
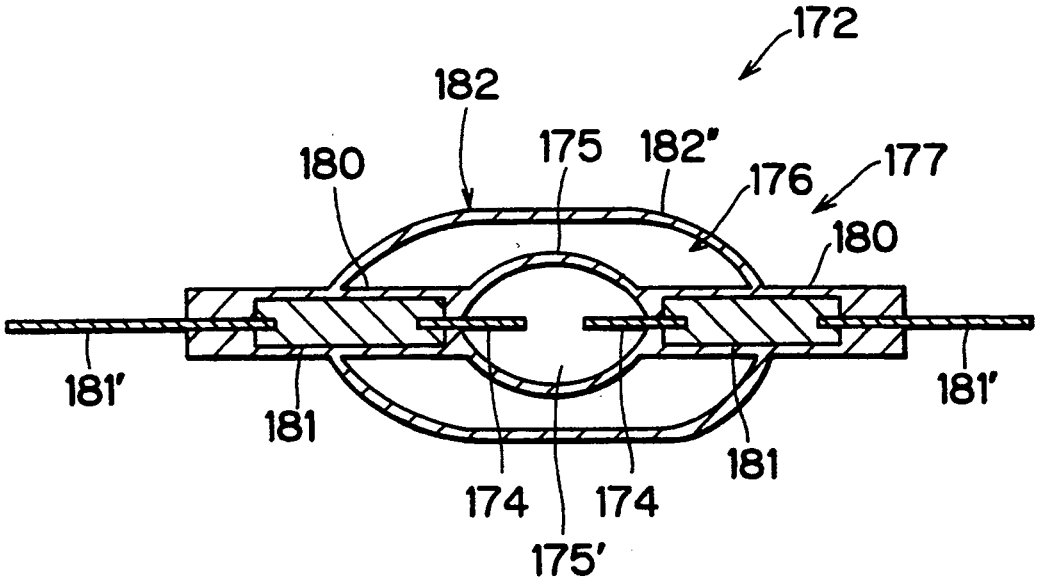
FIG. 3 PRIOR ART
FIG. 3 is a schematic side sectional view of another conventional discharge tube.

It should be further noted that the small-diameter hollow part 152*a* will be partly thermally deformed into the solid portion 53*a* of the outer tube 5, and the small-diameter hollow part 152*b* will be partly thermally deformed into the solid portion 53*b* of the outer tube 5, as will be described later. Since the diameter of the small-diameter portions 152*a* and 152*b* is small as described above, it becomes easier to thermally deform the small-diameter portions 152*a* and 152*b* into the solid portions 53 and 53*b*, relatively with respect to the case where the diameter of the outer tube is large, as in the conventional discharge tube shown in FIG. 1. Accordingly, it becomes possible to certainly form the solid portions 53*a* and 53*b* of the outer tube 5 in a short period of time.

It should be further noted that as apparent from FIG. 11(*b*), a jointed portion 800 of the open ends 180*a* and 180*b* is slightly shifted from a maximum diameter portion 151A of the large-diameter hollow portion 51 which has the maximum diameter. The jointed portion of the outer pipes 150*a* and 150*b* is thus slightly shifted from the maximum diameter portion 151A, for the following reasons: Since the jointed portion 800 of the outer pipes 150*a* and 150*b* may scatter the light generated in the arc discharge chamber 42′, the jointed portion 800 should be positioned apart from the center position of the arc discharge chamber 42′. In other words, since the jointed portion 800 may prevent the light generated in the arc discharge chamber 42′ from being effectively introduced in the forward direction, the jointed portion 800 should be positioned apart from the center position of the arc discharge chamber 42′. In addition, in order to enhance the strength of the obtained outer tube 5, the area of the jointed portion 800 of the outer pipes 150*a* and 150*b* should have a small value. Accordingly, the jointed portion should be positioned to be slightly shifted from the maximum diameter portion 151A.

In this respect, the jointed portion 800 is unnecessarily positioned as shown in FIG. 11, but should be positioned to be shifted from the maximum diameter portion 151A. It should be noted, however, that it is necessary that the inner diameter of at least one of the open ends 180*a* and 180*b* should be larger than the maximum outer diameter D1max of the spherically-shaped hollow portion 42 of the inner bulb 4, since the hollow portion 42 of the inner bulb 4 has to be inserted into either one of the outer pipes 150*a* and 150*b* through the corresponding open end.

As shown in FIG. 11(*b*), the first outer pipe 150*a* is then connected to an air suction pump 25 at its open end 181*a*, so that the interior of the first and second outer pipes 150*a* and 150*b* which are joined with each other as described above may be brought into a vacuum state. In other words, according to the present method of producing the discharge tube 3, the small-diameter hollow part 152*a* of the outer pipe 150*a* (the small-diameter hollow portion 52*a* of the outer tube 5) is utilized as an air intake pipe to be connected with the air suction pump 25.

Thereafter, the small-diameter hollow parts 152*a* and 152*b* of the first and second outer pipes 150*a* and 150*b* are thermally softened to be deformed into the solid parts 153*a* and 153*b*, respectively, as shown in FIG. 11(*c*). More specifically to say, the small-diameter hollow part 152*a* of the first outer pipe 150*a* is thermally softened at its area surrounding the molybdenum foil 43Ea and the molybdenum rod 43Fa, so that the solid part 153*a* with the molybdenum foil 43Ea and the molybdenum rod 43Fa being embedded therein is obtained. Similarly, the small-diameter hollow part 152*b* of the second outer pipe 150*b* is thermally softened at its area surrounding the molybdenum foil 43Eb and the molybdenum rod 43Fb, so that the solid part 153*b* with the molybdenum foil 43Eb and the molybdenum rod 43Fb being embedded therein is obtained. Though thermal expansion and thermal shrinkage are partly occurred in the glass wall of the small-diameter hollow parts 152*a* and 152*b* during the thermal deformation operation, since the molybdenum foils 43Ea and 43Eb are connected to the molybdenum rods 43Fa and 43Fb, crack is not generated in the obtained glass solid parts 153*a* and 153*b*, so that an undesired gap is not formed in the solid parts 153*a* and 153*b* around the molybdenum rods and the molybdenum foils, as described already.

Accordingly, the inner bulb 4 is sealingly enclosed in the interior of the first and second outer pipes 150*a* and 150*b* in such a manner that the inner bulb 4 is supported only via the lead wires 43*a* and 43*b* to the solid parts 153*a* and 153*b* of the first and second outer pipes 150*a* and 150*b*. Thus, the inner bulb 4 is held in the interior of the outer pipes 150*a* and 150*b* in such a manner that any part of the outer surface of the inner bulb 4 may not be contacted with the inner surfaces of the outer pipes 150*a* and 150*b* so that the annular gap 31 may be formed between the outer surface of the inner bulb 4 and the inner surface of the outer pipes 150*a* and 150*b*.

Then, the first and second outer pipes 150*a* and 150*b* are cut at positions indicated by broken lines 126 in FIG. 11(*c*), and thereafter the solid portions 53*a* and 53*b* of the outer tube 5 are formed from the solid parts 153*a* and 153*b* while the discharge tube 3 is separated from the air suction pump 25. As a result, the discharge tube 3 with the molybdenum rods 43Fa and 43Fb being respectively projected from the solid portions 53*a* and 53*b* is obtained. In other words, the discharge tube as shown in FIGS. 4(*a*) and 4(*b*) is obtained.

Though the second outer pipe 150*b* has a closed end 181*b* in the above description, the second outer pipe 150*b* may have an open end 181*b* which may be connected to another air suction pump. In this case, the air suction may be conducted not only through the open end 181*a* but also through the open end 181*b*.

According to the above-described method, since the inner bulb is inserted into the first and second outer pipes from the open ends formed on their large-diameter hollow parts, it is easy to insert the inner bulb into the outer pipes which are formed with the small-diameter hollow parts with their outer diameters being smaller than the outer diameter of the maximum diameter of the inner bulb. According to the above-described method, therefore, the discharge tube of the present invention can be easily obtained. In addition, according to the above-described method, the small-diameter hollow parts of the outer pipes are thermally deformed into the solid parts and are then cut out at their end portions.

Since the small-diameter hollow parts of the outer pipes which have the small diameter are thus subjected to the thermal deformation operation and the cutting operation, it is easy to perform the thermal deformation operation and the cutting operation.

In addition, according to the above-described method, the small-diameter hollow part of the outer pipe is directly connected to the air suction pump so that the air is drawn out from the interior of the outer pipes. That is, the small-diameter hollow part of the outer pipe is used also as an air suction pipe during the discharge tube producing operation. Accordingly, it becomes unnecessary to provide the outer pipe with another air suction pipe. Therefore, it becomes possible to decrease the number of the steps of producing the discharge tube. Furthermore, the obtained discharge tube has a simple structure and therefore has a high strength.

As described above, the discharge tube of the double-tube structure type of the present invention attains an improved heat accumulation property, since the inner bulb is supported in the outer tube only via the lead wires and therefore the inner bulb is not contacted with the outer tube. Accordingly, it becomes possible to increase the volume of the inner bulb, i.e., the volume of the arc discharge chamber, to thereby effectively prevent the inner surface of the wall of the arc discharge chamber from being attached with spattered matter. As a result, it becomes possible to increase a life time of the discharge tube.

According to the present invention, furthermore, the outer diameter of the small-diameter hollow portion of the outer tube to be inserted into the access through-hole of the reflective mirror is selected to be smaller than the maximum outer diameter of the spherically-shaped hollow portion of the inner bulb defining the arc discharge chamber. It is therefore possible to select the inner diameter of the access through-hole of the reflective mirror to be small relative to the arc discharge chamber of the inner bulb where light emission is occurred. Accordingly, in the light source constructed by the discharge tube and the reflective mirror, it becomes possible to decrease a ratio, with respect to the total amount of the light generated in the arc discharge chamber, of the amount of the light radiated into the access through-hole. It becomes therefore possible to effectively introduce the light generated in the arc discharge chamber forwardly of the light source.

In addition, the discharge tube is combined with the reflective mirror into the light source in such a manner that the access through-hole may be positioned completely within the shadow space area of the discharge tube. Accordingly, it becomes possible to decrease a loss of the intensity of the light as small as possible to such an amount that is inherently occurred due to the structure of the discharge tube. Thus, according to the light source of the present invention, it becomes possible to effectively introduce light onto the LC display panel with a low amount of light intensity loss so that a large intensity of light may be irradiated on the LC display.

While the present invention has been described in detail and with reference to the specific embodiment thereof, it will be apparent to one skilled in the art that various changes and modifications can be made therein without departing from the spirit and scope thereof.

For example, in the above-described embodiment of the discharge tube of the present invention, the maximum outer diameter of the spherically-shaped hollow portion 42 of the inner bulb 4 is selected to be equal to or larger than both the diameter of the small-diameter hollow portions 52*a* and 52*b* of the outer tube 5, but the maximum outer diameter of the spherically-shaped hollow portion 42 may be selected to be equal to or larger than only the diameter of the small-diameter hollow portion 52*a* of the outer tube 5 which is to be inserted into the access hole 21 of the reflective mirror 2.

In place of the nickel buffer wire 43Cb, a buffer wire formed of molybdenum may be utilized.

Furthermore, the method of producing the discharge tube of the present invention is not limited to the above-described method. For example, an air suction pipe may be previously integrally formed on a peripheral side surface of at least one of the outer pipes 150*a* and 150*b*. In this case, the air suction operation for the outer pipes are operated by connecting the air suction pump 25 to the air suction pipe provided on the outer pipe. Thereafter, the air suction pipe formed on the outer pipe is thermally deformed at its base portion to be cut into a chip portion.

What is claimed is:

1. A discharge tube for emitting light, comprising:

an inner bulb including a bulb wall having an inner surface for defining an arc discharge chamber for enclosing therein gas for emitting light and an outer surface for defining an outer diameter of a first value and a pair of solid portions continuously connected from the bulb wall, each for supporting a corresponding one of a pair of electrodes and corresponding one of a pair of metal members which is connected to the corresponding one of the pair of electrodes, the pair of electrodes being projected in the arc discharge chamber from the pair of solid portions and the pair of metal members being projected outwardly of said inner bulb from the pair of solid portions, the pair of solid portions having an outer surface; and an outer tube for sealingly enclosing therein the inner bulb, said outer tube including a tube wall having a large-diameter part having an inner surface for defining a large-diameter hollow portion and a small-diameter cylindrically-shaped part continuously connected from the large-diameter part, the small-diameter cylindrically-shaped part having an inner surface for defining a small-diameter hollow portion and an outer surface defining a substantially constant outer diameter of a second value which is equal to or smaller than the first value, said inner bulb being enclosed in said outer tube with the metal members projected outwardly of said inner bulb being supported by said tube wall, the large-diameter hollow portion receiving therein an entire part of the bulb wall of said inner bulb with a gap being formed between the outer surface of the bulb wall and the inner surface of the large-diameter part, the small-diameter hollow portion receiving therein at least a part of one of the pair of solid portions of said inner bulb and the metal member projected from the solid portion with a gap being formed between the outer surface of the part of the solid portion and the inner surface of the small-diameter cylindrically-shaped part.

2. The discharge tube as claimed in claim 1, wherein the one of the pair of solid portions of said inner bulb received in the small-diameter hollow portion has the outer surface for defining a substantially constant outer diameter of a third value, and wherein the small-diameter cylindrically-shaped part of said outer tube has the inner surface for defining the small-diameter hollow portion having a substantially constant inner diameter of a fifth value which is larger than the third value so that a gap of a substantially constant size may be formed between the inner surface of the small-diameter cylindrically-shaped part and the outer surface of the solid portion of said inner bulb received in the small-diameter hollow portion.

3. The discharge tube as claimed in claim 2, wherein the large-diameter part of said outer tube has the inner surface for defining an inner diameter of a fourth value which is larger than the first value so that a gap may be formed between the outer surface of the bulb wall of said inner bulb and the inner surface of the large-diameter part of said outer tube.

4. The discharge tube as claimed in claim 3, wherein said outer tube further includes a solid portion which is continuously connected to the small-diameter cylindrically-shaped part, the solid portion of said outer tube supporting the metal member projected outwardly from the solid portion of said inner bulb received in the small-diameter hollow portion of said outer tube, to thereby hold said inner bulb in the interior of the large-diameter hollow portion and the small-diameter hollow portion of said outer tube, with a gap being formed between the outer surface of the inner bulb and the inner surface of the outer tube.

5. The discharge tube as claimed in claim 1, wherein the pair of solid portions of said inner bulb extend along a predetermined axis from a pair of positions of the bulb wall defining opposite sides of the arc discharge chamber along the predetermined axis, the bulb wall having an annular cross section along a plane perpendicular to the predetermined axis, the annular cross section having the outer diameter defined by the outer surface, the outer diameter varying along the predetermined axis and having the first value at a maximum, the pair of electrodes being projected inside of the arc discharge chamber from the corresponding solid portions along the predetermined axis and the pair of metal members being projected outwardly of said inner bulb from the corresponding solid portions along the predetermined axis, and wherein the tube wall of said outer tube includes a pair of small-diameter cylindrically-shaped parts extending along the predetermined axis from opposite sides of the large-diameter part along the predetermined axis, the pair of small-diameter cylindrically-shaped parts having a pair of outer surfaces and a pair of inner surfaces for defining a pair of small-diameter hollow portions, each of the pair of small-diameter parts having an annular cross section along a plane perpendicular to the predetermined axis, the annular cross section having the outer diameter of the second value which is equal to or smaller than the first value, the second value being substantially constant along the predetermined axis, said outer tube enclosing therein said inner bulb in such a manner that the large-diameter hollow portion receives therein an entire part of the arc discharge chamber of said inner bulb, with a gap being formed between the outer surface of the bulb wall of said inner bulb and the inner surface of the large-diameter part of said outer tube, and each of the pair of small-diameter hollow portions receives therein at least a part of a corresponding one of the pair of solid portions of said inner bulb and a corresponding one of the pair of metal members projected from the corresponding one of the pair of solid portions, with a gap being formed between the outer surface of the corresponding solid portion and the inner surface of the corresponding small-diameter hollow portion.

6. The discharge tube as claimed in claim 5, wherein each of the pair of solid portions of said inner bulb has a circular cross section along a plane perpendicular to the predetermined axis which has the outer diameter of a third value, the third value being substantially constant along the predetermined axis, and wherein the large-diameter part of said outer tube has an annular cross section along a plane perpendicular to the predetermined axis which has an inner diameter which is larger than the outer diameter of the bulb wall of said inner bulb at any position along the predetermined axis so that a gap may be formed between the outer surface of the bulb wall of said inner bulb and the inner surface of the large-diameter hollow portion of said outer tube, and each of the pair of small-diameter cylindrically-shaped parts of said outer tube has an annular cross section along a plane perpendicular to the predetermined axis, the annular cross section having an inner diameter of a fifth value, the fifth value being substantially constant along the predetermined axis, the fifth value being larger than the third value so that a gap having a substantially constant size along the predetermined axis may be formed between the outer surface of the part of each of the pair of solid portions of said inner bulb received in the corresponding small-diameter hollow portion and the inner surface of the corresponding small-diameter hollow portion of said outer tube.

7. The discharge tube as claimed in claim 5, wherein said outer tube further includes a pair of solid portions each of which is continuously connected to a corresponding one of the pair of small-diameter cylindrically-shaped parts of the tube wall, each of the pair of solid portions of said outer tube supporting the metal member projected outwardly of a corresponding one of the pair of solid portions of said inner bulb which is received in a corresponding one of the pair of small-diameter hollow portions directly connected to the each of the pair of solid portions of said outer tube, to thereby hold said inner bulb in the interior of the large-diameter hollow portion and the pair of small-diameter hollow portions of said outer tube, with a gap being formed between the outer surface of the inner bulb and the inner surface of the outer tube.

8. A light source for emitting light in a desired direction, comprising:

a discharge tube which includes: an inner bulb including a bulb wall having an inner surface for defining an arc discharge chamber for enclosing therein gas for emitting light and an outer surface for defining an outer diameter of a first value and a pair of solid portions continuously connected from the bulb wall, each for supporting a corresponding one of a pair of electrodes and a corresponding one of a pair of metal members which is connected to the corresponding one of the pair of electrodes, the pair of electrodes being projected in the arc discharge chamber from the pair of solid portions and the pair of metal members being projected outwardly of the inner bulb from the pair of solid portions, the pair of solid portions having an outer surface; and an outer tube for sealingly enclosing therein the inner bulb, the outer tube including a tube wall having a large-diameter part having an inner surface for defining a large-diameter hollow portion and a small-diameter cylindrically-shaped part continuously connected from the large-diameter part, the small-diameter cylindrically-shaped part having an inner surface for defining a small-diameter hollow portion and an outer surface defining a substantially constant outer diameter of a second value which is equal to or smaller than the first value, said inner bulb being enclosed in said outer tube with the metal members projected outwardly of said inner bulb being supported by said tube wall, the large-diameter hollow portion receiving therein an entire part of the arc discharge chamber of said inner bulb with a gap being formed between the outer surface of the bulb wall of said inner bulb and the inner surface of the large-diameter part of said outer tube, the small-diameter hollow portion receiving therein at least a part of one of the pair of solid portions of said inner bulb and the metal member projected from the solid portion with a gap being formed between the outer surface of the part of the solid portion of said inner bulb and the inner surface of the small-diameter cylindrically-shaped part of said outer tube; and a reflective mirror for receiving the light emitted from the arc discharge chamber and reflecting the light in a desired direction, said reflective mirror being formed with a support wall having an inner surface extending along a predetermined axis and defining a through-hole for receiving therein the small-diameter cylindrically-shaped part of the outer tube of said discharge tube.

9. The light source as claimed in claim 8, wherein said discharge tube is attached to said reflective mirror in such a manner that the through-hole of said reflective mirror may be positioned within a shadow space area where light having passed through a portion of the inner bulb having a light transmittance of a low value is reaches.

10. The light source as claimed in claim 8, wherein the one of the pair of solid portions of the inner bulb of said discharge tube received in the small-diameter hollow portion of said outer tube has the outer surface for defining a substantially constant outer diameter of a third value, wherein the small-diameter cylindrically-shaped part of the outer tube of said discharge tube has the inner surface for defining the small-diameter hollow portion having a substantially constant inner diameter of a fifth value which is larger than the third value so that a gap of a substantially constant size may be formed between the inner surface of the small-diameter cylindrically-shaped part of said outer tube and the outer surface of the solid portion of said inner bulb received in the small-diameter hollow portion, the large-diameter part of the outer tube having the inner surface for defining an inner diameter of a fourth value which is larger than the first value so that a gap may be formed between the outer surface of the bulb wall of the inner bulb and the inner surface of the large-diameter part of the outer tube, and wherein said discharge tube is attached to said reflective mirror in such a manner that the small-diameter cylindrically-shaped part of the outer tube is inserted into the through-hole along the inner surface of the support wall of said reflective mirror and fixed to the through-hole, the through-hole having a substantially constant inner diameter of a sixth value which is equal to or slightly larger than the second value.

11. The light source as claimed in claim 10, wherein the outer tube of said discharge tube further includes a solid portion which is continuously connected to the small-diameter cylindrically-shaped part, the solid portion of the outer tube supporting the metal member projected outwardly of the solid portion of the inner bulb received in the small-diameter hollow portion of the tube wall to thereby hold the inner bulb in the interior of the large-diameter hollow portion and the small-diameter hollow portion of the outer tube, with a gap being formed between the outer surface of the inner bulb and the inner surface of the outer tube.

12. The light source as claimed in claim 9, wherein said discharge tube is attached to said reflective mirror in such a manner that the through-hole of said reflective mirror may be positioned within a cone-shaped shadow space area with its generating line connecting a tip end of the electrode projected in the arc discharge chamber from the solid portion of the inner bulb received in the small-diameter cylindrically-shaped part of the outer tube and a boundary portion between the bulb wall and the solid portion of the inner bulb.

13. The light source as claimed in claim 8, wherein the pair of solid portions of said inner bulb extended along a predetermined axis from a pair of positions of the bulb wall defining opposite sides of the arc discharge chamber along the predetermined axis, the bulb wall having an annular cross section along a plane perpendicular to the predetermined axis, the annular cross section having the outer diameter defined by the outer surface, the outer diameter varying along the predetermined axis and having the first value at a maximum, the pair of electrodes being projected inside of the arc discharge chamber from the corresponding solid portions along the predetermined axis and the pair of metal members being projected outwardly of the inner bulb from the corresponding solid portions along the predetermined axis, each of the pair of solid portions of the inner bulb having a circular cross section along a plane perpendicular to the predetermined axis which has the outer diameter of a third value, the third value being substantially constant along the predetermined axis, wherein the tube wall of the outer tube of said discharge tube includes a pair of small-diameter cylindrically-shaped parts extending along the predetermined axis from opposite sides of the large-diameter part along the predetermined axis, the pair of small-diameter cylindrically-shaped parts having a pair of outer surfaces and a pair of inner surfaces for defining a pair of small-diameter hollow portions, each of the pair of small-diameter parts having an annular cross section along a plane perpendicular to the predetermined axis, the annular cross section having the outer diameter of the second value which is equal to or smaller than the first value, the second value being substantially constant along the predetermined axis, said outer tube enclosing therein the inner bulb in such a manner that the large-diameter hollow portion receives therein an entire part of the arc discharge chamber of said inner bulb and each of the pair of small-diameter hollow portions receives therein at least a part of a corresponding one of the pair of solid portions of the inner bulb and a corresponding one of the pair of metal members projected from the corresponding one of the pair of solid portions, the large-diameter part of the outer tube having an annular cross section along a plane perpendicular to the predetermined axis which has an inner diameter which is larger than the outer diameter of the bulb wall of said inner bulb at any position along the predetermined axis so that a gap may be formed between the outer surface of the bulb wall of the inner bulb and the inner surface of the large-diameter hollow portion of the outer tube, each of the pair of small-diameter cylindrically-shaped parts of said outer tube having an annular cross section along a plane perpendicular to the predetermined axis, the annular cross section having an inner diameter of a fifth value, the fifth value being substantially constant along the predetermined axis, the fifth value being larger than the third value so that a gap having a substantially constant size along the predetermined axis may be formed between the outer surface of the part of each of the pair of solid portions of said inner bulb received in the corresponding small-diameter hollow portion and the inner surface of the corresponding small-diameter hollow portion of said outer tube, and wherein said discharge tube is attached to said reflective mirror in such a manner that one of the pair of small-diameter cylindrically-shaped parts having the substantially constant outer diameter of the second value is inserted into the through-hole along the inner surface of the support wall and fixed to the through-hole, the through-hole having a substantially constant inner diameter of a sixth value which is equal to or slightly larger than the second value.

14. The light source as claimed in claim 13, wherein the outer tube of said discharge tube further includes a pair of solid portions each of which is continuously connected to a corresponding one of the pair of small-diameter cylindrically-shaped parts of the tube wall, each of the pair of solid portions of the outer tube supporting the metal member projected outwardly of the corresponding one of the pair of solid portions of the inner bulb which is received in a corresponding one of the pair of small-diameter hollow portions directly connected to each of the pair of solid portions of said outer tube, to thereby hold the inner bulb in the interior of the large-diameter hollow portion and the pair of small-diameter hollow portions of the outer tube, with a gap being formed between the outer surface of the inner bulb and the inner surface of the outer tube.

15. The light source as claimed in claim 14, wherein said discharge tube is attached to said reflective mirror in such a manner that the through-hole of said reflective mirror may be positioned within a cone-shaped shadow space area with its generating line connecting a tip end of one of the pair of electrodes which is projected in the arc discharge chamber from one of the pair of solid portions of the inner bulb received in the one of the pair of small-diameter cylindrically-shaped parts of the outer tube inserted in the through-hole of said reflective mirror and a boundary portion between the bulb wall and the solid portion of the inner bulb.

16. The discharge tube as claimed in claim 7, wherein the bulb wall defines the arc discharge chamber of substantially a spherical shape which has the largest annular cross section substantially at its central position with respect to the predetermined axis, the largest annular cross section having the outer diameter of the first value.

17. The discharge tube as claimed in claim 7, wherein the second value of the outer diameter of each of the pair of small-diameter cylindrically-shaped parts is determined dependently on a positional relationship between a tip end of the electrode projected in the arc discharge chamber from the solid portion of said inner bulb and a boundary portion between the bulb wall and the solid portion of the inner bulb.

18. The discharge tube as claimed in claim 7, wherein a thickness of the bulb wall of said inner bulb varies along the predetermined axis for attaining a lens function with respect to light emitted in the arc discharge chamber.

19. The light source as claimed in claim 14, wherein the tube wall of the outer tube further has a connecting part for continuously connecting the large-diameter part with the small-diameter cylindrically-shaped part, the connecting part having an annular cross section along a plane perpendicular to the predetermined axis which has an outer diameter of the sixth value, and wherein a distance L1 defined between the center position of tip ends of the pair of electrodes projected in the arc discharge chamber and the annular cross section of the connecting part along the predetermined axis satisfies an inequality $L1 < Fr + (La/2)$ where Fr represents the focal length of said reflective mirror and La represents a distance between the tip ends of the pair of electrodes, said discharge tube being positioned relative to said reflective mirror in such a manner that the center position of the tip ends of the pair of electrodes is located on a focal point of said reflective mirror.

20. The light source as claimed in claim 14, wherein the outer surface of one of the pair of solid portions of said inner bulb received in one of the pair of small-diameter cylindrically-shaped parts of said outer tube inserted into the through-hole and a part of the outer surface of the bulb wall adjacent to the one of the pair of solid portions are covered with a light-shielding film, the light-shielding film having an edge on the outer surface of the bulb wall, and wherein said discharge tube is attached to said reflective mirror in such a manner that the through-hole of said reflective mirror may be positioned within a cone-shaped shadow space area with its generating line connecting a tip end of the electrode projected in the arc discharge chamber from the solid portion of the inner bulb received in the small-diameter cylindrically-shaped part of the outer tube inserted in the through-hole and the edge portion of the light-shielding film.

21. A discharge tube for emitting light, comprising:

an inner bulb including a bulb wall having an inner surface for defining an arc discharge chamber for enclosing therein gas to emit light and an outer surface and a pair of solid portions continuously connected from the bulb wall, each for supporting a corresponding one of a pair of electrodes and a corresponding one of a pair of metal members which is connected to the corresponding one of the pair of electrodes, the pair of solid portions having an outer surface, the pair of solid portions extending along a predetermined axis from a pair of positions of the bulb wall defining opposite sides of the arc discharge chamber along the predetermined axis, the bulb wall having a cross section along a plane perpendicular to the predetermined axis which has a second outer size defined by the outer surface of the bulb wall, the first outer size varying along the predetermined axis and having a first value at a maximum, the pair of electrodes being projected inside of the arc discharge chamber from the corresponding solid portions along the predetermined axis and the pair of metal members being projected outwardly of said inner bulb from the corresponding solid portions along the predetermined axis; and an outer tube for sealingly enclosing therein said inner bulb, said outer tube including a tube wall having a large-size part having an inner surface for defining a large-size hollow portion and a pair of small-size parts extending along the predetermined axis from opposite sides of the large-size part along the predetermined axis, the pair of small-size parts having a pair of outer surfaces and a pair of inner surfaces for defining a pair of small-size hollow portions, each of the pair of small-size parts having a cross section along a plane perpendicular to the predetermined axis which has a second outer size defined by the outer surface of the corresponding small-size part, the second outer size being substantially constant along the predetermined axis and having a second value which is equal to or smaller than the first value, said outer tube enclosing therein said inner bulb in such manner that the large-size hollow portion receives therein an entire part of the bulb wall of said inner bulb, with a gap being formed between the outer surface of the bulb wall and the inner surface of the large-size part, and each of the pair of small-size hollow portions receives therein at least a part of a corresponding one of the pair of solid portions of said inner bulb and a corresponding one of the pair of metal members projected from the corresponding one of the pair of solid portions, with a gap being formed between the outer surface of the corresponding solid portion and the inner surface of the corresponding small-size hollow portion.

22. The discharge tube as claimed in claim 21, wherein each of the pair of solid portions of said inner bulb has a cross section along a plane perpendicular to the predetermined axis which has a third outer size defined by the outer surface of the corresponding solid portion, the third outer size being substantially constant along the predetermined axis and having a third value, wherein the cross section of each of the pair of small-size parts of said outer tube has a first inner size defined by the inner surface of the corresponding small-size part, the first inner size being substantially constant along the predetermined axis and having a fifth value which is larger than third value so as to form a gap having a substantially constant size along the predetermined axis between the outer surface of the part of each of the pair of solid portions and the inner surface of the corresponding small-size hollow portion, wherein the large-size part of said outer tube has a cross section along a plane perpendicular to the predetermined axis which has a second inner size defined by the inner surface of the large-size part, the second inner size varying along the predetermined axis, the second inner size being larger than the outer size of the bulb wall at any position along the predetermined axis so as to form a gap between the outer surface of the bulb wall and the inner surface of the large-size part, and wherein said outer tube further includes a pair of solid portions each of which is continuously connected to a corresponding one of the pair of small-size parts of the tube wall, each of the pair of solid portions of said outer tube supporting the metal member projected outwardly of a corresponding one of the pair of solid portions of said inner bulb which is received in a corresponding one of the pair of small-size hollow portions directly connected to the each of the pair of solid portions of said outer tube, to thereby hold said inner bulb in the interior of the large-size hollow portion and the pair of small-size hollow portions of said outer tube, with a gap being formed between the outer surface of the inner bulb and the inner surface of the outer tube.

23. The discharge tube as claimed in claim 22, wherein each of the bulb wall of said inner bulb and the tube wall of said outer tube has a cross section along a plane perpendicular to the predetermined axis which has an outer diameter defined by a corresponding outer surface and representative of a corresponding outer size and having an inner diameter defined by a corresponding inner surface and representative of a corresponding inner size, and wherein each of the pair of solid portions of said inner bulb and the pair of solid portions of said outer tube has a cross section along a plane perpendicular to the predetermined axis which has an outer diameter defined by a corresponding outer surface and representative of a corresponding outer size.

24. The discharge tube as claimed in claim 22, wherein each of the bulb wall of said inner bulb and the tube wall of said outer tube has an annular cross section along a plane perpendicular to the predetermined axis, the annular cross section having an outer diameter defined by a corresponding outer surface and representative of a corresponding outer size and having an inner diameter defined by a corresponding inner surface and representative of a corresponding inner size, and wherein each of the pair of solid portions of said inner bulb and the pair of solid portions of said outer tube has a circular cross section along a plane perpendicular to the predetermined axis, the circular cross section having an outer diameter defined by a corresponding outer surface and representative of a corresponding outer size.

25. The discharge tube as claimed in claim 22, wherein the second value of the second outer size of each of the pair of small-size parts is determined dependently on a positional relationship between a tip end of the electrode projected in the arc discharge chamber from the solid portion of said inner bulb and a boundary portion between the bulb wall and the solid portion of the inner bulb.

26. A light source for emitting light in a desired direction, comprising:

a discharge tube which includes:

an inner bulb including a bulb wall having an outer surface and an inner surface for defining an arc discharge chamber for enclosing therein gas to emit light and a pair of solid portions continuously connected from the bulb wall, each for supporting a corresponding one of a pair of electrodes and a corresponding one of a pair of metal members which is connected to the corresponding one of the pair of electrodes, the pair of solid portions having an outer surface, the pair of solid portions extending along a predetermined axis from a pair of positions of the bulb wall defining opposite sides of the arc discharge chamber along the predetermined axis, the bulb wall having a cross section along a plane perpendicular to the predetermined axis which has a first outer size defined by the outer surface of the bulb wall, the first outer size varying along the predetermined axis and having a first value at a maximum, the pair of electrodes being projected inside of the arc discharge chamber from the corresponding solid portions along the predetermined axis and the pair of metal members being projected outwardly of said inner bulb from the corresponding solid portions along the predetermined axis; and an outer tube for sealingly enclosing therein said inner bulb, said outer tube including a tube wall having a large-size part having an inner surface for defining a large-size hollow portion and a pair of small-size parts extending along the predetermined axis from opposite sides of the large-size part along the predetermined axis, the pair of small-size parts having a pair of outer surfaces and a pair of inner surfaces for defining a pair of small-size hollow portions, each of the pair of small-size parts having a cross section along a plane perpendicular to the predetermined axis which has a second outer size defined by the outer surface of the corresponding small-size part, the second outer size being substantially constant along the predetermined axis and having a second value which is equal to or smaller than the first value, said outer tube enclosing therein said inner bulb in such a manner that the large-size hollow portion receives therein an entire part of the bulb wall of said inner bulb, with a gap being formed between the outer surface of the bulb wall and the inner surface of the large-size part, and each of the pair of small-size hollow portions receives therein at least a part of a corresponding one of the pair of solid portions of said inner bulb and a corresponding one of the pair of metal members projected from the corresponding one of the pair of solid portions, with a gap being formed between the outer surface of the corresponding solid portion and the inner surface of the corresponding small-size hollow portion; and a reflective mirror for receiving light emitted from the arc discharge chamber and for reflecting light in a desired direction, said reflective mirror being formed with a support wall having an inner surface extending along the predetermined axis and defining a through-hole for receiving therein one of the pair of small-size parts of the outer tube of said discharge tube.

27. The light source as claimed in claim 26, wherein said discharge tube is attached to said reflective mirror in such a manner that the one of the pair of small-size parts of the outer tube having the substantially constant outer size of the second value is inserted into the through-hole along the inner surface of the support wall of said reflective mirror along the predetermined axis and fixed to the through-hole of said reflective mirror, the through-hole having a substantially constant inner size of a sixth value which is equal to or slightly larger than the second value.

28. The light source as claimed in claim 27, wherein each of the pair of solid portions of said inner bulb has a cross section along a plane perpendicular to the predetermined axis which has a third outer size defined by the outer surface of the corresponding solid portion, the third outer size being substantially constant along the predetermined axis and having a third value, wherein the cross section of each of the pair of small-size parts of said outer tube has a first inner size defined by the inner surface of the corresponding small-size part, the first inner size being substantially constant along the predetermined axis and having a fifth value which is larger than the third value so as to form a gap having a substantially constant size along the predetermined axis between the outer surface of the part of each of the pair of solid portions and the inner surface of the corresponding small-size hollow portion, wherein the large-size part of said outer tube has a cross section along a plane perpendicular to the predetermined axis which has a second inner size defined by the inner surface of the large-size part, the second inner size varying along the predetermined axis, the second inner size being larger than the outer size of the bulb wall at any position along the predetermined axis so as to form a gap between the outer surface of the bulb wall and the inner surface of the large-size part, and wherein said outer tube further includes a pair of solid portions each of which is continuously connected to a corresponding one of the pair of small-size parts of the tube wall, each of the pair of solid portions of said outer tube supporting the metal member projected outwardly of a corresponding one of the pair of solid portions of said inner bulb which is received in a corresponding one of the pair of small-size hollow portions directly connected to each of the pair of solid portions of said outer tube, to thereby hold said inner bulb in the interior of the large-size hollow portion and the pair of small-size hollow portions of said outer tube, with a gap being formed between the outer surface of the inner bulb and the inner surface of the outer tube.

29. The light source as claimed in claim 28, wherein each of the bulb wall of said inner bulb and the tube wall of said outer tube has a cross section along a plane perpendicular to the predetermined axis which has an outer diameter defined by a corresponding outer surface and representative of a corresponding outer size and having an inner diameter defined by a corresponding inner surface and representative of a corresponding inner size, wherein each of the pair of solid portions of said inner bulb and the pair of solid portions of said outer tube has a cross section along a plane perpendicular to the predetermined axis which has an outer diameter defined by a corresponding outer surface and representative of a corresponding outer size, and wherein the through-hole of said reflective mirror has a cross section along a plane perpendicular to the predetermined axis which has an inner diameter defined by the inner surface of the support wall and representative of the inner size of the through-hole.

30. The light source as claimed claim 28, wherein each of the bulb wall of said inner bulb and the tube wall of said outer tube has an annular cross section along a plane perpendicular to the predetermined axis, the annular cross section having an outer diameter defined by a corresponding outer surface and representative of a corresponding outer size and having an inner diameter defined by a corresponding inner surface and representative of a corresponding inner size, wherein each of the pair of solid portions of said inner bulb and the pair of solid portions of said outer tube has a circular cross section along a plane perpendicular to the predetermined axis, the circular cross section having an outer diameter defined by a corresponding outer surface and representative of a corresponding outer size, and wherein the through-hole of said reflective mirror has a circular cross section along a plane perpendicular to the predetermined axis which has an inner diameter defined by the inner surface of the support wall and representative of the inner size of the through-hole.

31. The light source as claimed in claim 28, wherein said discharge tube is positioned relative to said reflective mirror in such a manner that the center position of tip ends of the pair of electrodes projected in the arc discharge chamber of the inner bulb is located on a focal point of said reflective mirror.

32. The light source as claimed in claim 31, wherein the tube wall of the outer tube further has a connecting part for continuously connecting the large-size part with the one of the pair of small-size parts inserted in the through-hole, the connecting part having a cross section along a plane perpendicular to the predetermined axis which has an outer diameter of the sixth value, and wherein a distance L1 between the center position of the tip ends of the pair of electrodes projected in the arc discharge chamber and the cross section of the connecting part along the predetermined axis satisfies an inequality $L1<Fr+(La/2)$ where Fr represents a focal length of said reflective mirror and La represents a distance between the tip ends of the pair of electrodes.

33. The light source as claimed in claim 32, wherein said discharge tube is attached to said reflective mirror in such a manner that the through-hole of said reflective mirror may be positioned within a cone-shaped shadow space area with its generating line connecting a tip end of one of the pair of electrodes which is projected in the arc discharge chamber from one of the pair of solid portions of the inner bulb received in the one of the pair of small-size parts of the outer tube inserted in the through-hole of said reflective mirror and a boundary portion between the bulb wall and the solid portion of the inner bulb.

* * * * *